US006783205B2

(12) United States Patent
Saijo et al.

(10) Patent No.: US 6,783,205 B2
(45) Date of Patent: Aug. 31, 2004

(54) INK JET RECORDING APPARATUS AND HANDLING METHOD THEREOF

(75) Inventors: Yasutsugu Saijo, Tokyo (JP); Yuji Hamasaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/050,930

(22) Filed: Jan. 22, 2002

(65) Prior Publication Data

US 2002/0097292 A1 Jul. 25, 2002

(30) Foreign Application Priority Data

Jan. 22, 2001 (JP) ..... 2001-013078
Sep. 17, 2001 (JP) ..... 2001-281258

(51) Int. Cl.[7] ..... B41J 2/165
(52) U.S. Cl. ..... 347/30; 347/29; 347/30; 347/35
(58) Field of Search ..... 347/23, 29, 30, 347/35

(56) References Cited

U.S. PATENT DOCUMENTS 5,625,384 A * 4/1997 Numata et al. ..... 347/23
5,627,572 A * 5/1997 Harrington, III et al. ..... 347/23
6,074,037 A * 6/2000 Nakahara et al. ..... 347/29
6,106,097 A 8/2000 Otani et al.
6,231,157 B1 5/2001 Saijo
6,364,448 B2 * 4/2002 Nishioka et al. ..... 347/23

* cited by examiner

*Primary Examiner*—Stephen D. Meier
*Assistant Examiner*—Ly T Tran
(74) *Attorney, Agent, or Firm*—Fitzpatrick, Cella, Harper & Scinto

(57) ABSTRACT

An ink jet recording apparatus includes a carriage for mounting a recording head for effecting recording by discharging recording ink and for moving the recording head, and a recovery unit for effecting a recovery operation with respect to the recording head. The recording apparatus is forwarded from a manufacturing factory in a condition that the recording head filled with transporting ink different from the recording ink is mounted on the carriage, and further wherein an on-arrival recovery mode executed by the recovery unit upon first usage of the recording apparatus by the user differs from a normal recovery mode executed by the recovery unit after the first usage.

35 Claims, 17 Drawing Sheets

INK JET RECORDING APPARATUS AND HANDLING METHOD THEREOF

BACKGROUND OF THE INVENTION

1. Field of the Invention

The present invention relates to an ink jet recording apparatus and a handling method thereof, and more particularly, it relates to an ink jet recording apparatus which is forwarded or shipped from a manufacturing factory in a condition that transporting ink different from recording ink is filled in a recording head, and a method for handling such an ink jet recording apparatus.

2. Related Background Art

As recording apparatuses having a printer, copier or facsimile function or recording apparatuses (printing apparatuses) used as a composite electronic equipment including a computer or a word processor or as an output equipment such as a work station, there has widely been proposed an ink jet recording apparatus in which recording is executed by discharging ink toward a recording medium (recording paper and the like) such as paper, cloth, plastic sheet, OHP sheet and the like in response to image information (recording information). Further, there are various requirements for material of the recording medium, and, recently, development for such requirements has been advanced, with the result that an ink jet recording apparatus, in which cloth, leather, non-woven fabric or metal, as well as paper (including thin paper and treated paper) as a normal recording medium or a resin film (OHP sheet and the like) is used as the recording medium, has been utilized.

The ink jet recording apparatus has widely been applied to printers, copiers and facsimile devices since it has low noise and low running cost and it can easily be made compact and forms colored images. A discharge port (normally, plural discharge ports) for discharging an ink droplet is formed in a front surface of an ink discharge head (ink jet recording head as ink jet recording means) of the ink jet recording apparatus. Although a dimension of the discharge port has been in the range of several tens of $\mu$ms, recently, the dimension of the discharge port has been reduced more and more as a higher quality image has been requested. On the basis of a discharge signal processed in the apparatus in response to liquid droplet discharge information (recording data and the like) sent from a host machine, the ink droplet is discharged from the discharge port to form an image (including characters and symbols) on the recording medium.

In the ink jet recording apparatus in which the recording is effected by discharging the ink from the ink jet recording head as the recording means toward the recording medium, since the recording is effected by discharging the ink from the fine discharge port, the discharge port may be clogged to cause poor discharge (including non-discharge), thereby deteriorating the quality of the recorded image. To avoid this, recovery means for recovering and maintaining ink discharge performance of the recording head has been used. As such recovery means, for example, there has been used suction means for recovering and maintaining the ink discharge performance by refreshing the ink in the discharge port by suction-removing foreign matters such as viscosity-increased ink and a bubble from the discharge port by generating negative pressure within capping means by driving a capping mechanism for capping the discharge port of the recording head and a pump connected to the capping mechanism in a capping condition, or recovery means including a wiper (wiping means) for wiping (cleaning) foreign matters such as ink adhered to the discharge port face of the recording head.

On the other hand, in the ink jet recording apparatus, in consideration of user's convenience and saving, there has been proposed a so-called tank exchanging type in which an ink tank containing ink jet recording ink can be mounted on the recording head independently and can be exchanged into a new one when the ink is used up. Further, in the past, the recording head could easily be dismounted from a main body of the recording apparatus so that it can be exchanged by a new one by the user if the head is damaged.

However, in consideration of reliability and endurance of the recording head itself, there is an aspect in which the recording apparatus is forwarded from a recording apparatus manufacturing factory in a condition that the recording head was previously mounted on the main body of the recording apparatus. In this case, the recording apparatus is forwarded in an arrangement (condition) that the recording head itself is fixed to the recording apparatus so that mounting and dismounting of the recording head cannot be effected by the user. In such a case, it is more preferable to adopt an aspect in which the recording apparatus is forwarded from the manufacturing factory in a condition that the ink tank detachable with respect to the recording head is mounted on the ink jet recording head, as well as the ink jet recording head mounted on the recording apparatus, since a user's setting-up operation upon usage of the apparatus can be reduced.

However, in such a case, the recording apparatus is forwarded from the manufacturing factory and transported to the user in a condition that the ink jet recording head is always filled with the recording ink. During the transportation, if the apparatus is exposed to a high temperature or is subjected to thermal shock due to so-called heat cycle from a high temperature to a low temperature, the ink may be solidified in the recording head due to evaporation of moisture from the recording ink within the recording head or change in condition may occur on an inner surface of the recording head, with the result that good recording performance of the ink jet recording head cannot be maintained.

To avoid this, it was considered to provide an arrangement in which the ink jet recording head is mounted on the main body of the apparatus in a condition that the head is filled with transporting ink and, on the other hand, the ink tank containing the recording ink is not mounted on the recording head but is packed separately and is housed together with the recording apparatus in a package for the entire apparatus. In this case, as the transporting ink, ink in which components in the recording ink that easily adhere are reduced as much as possible in comparison with the recording ink, the water ratio is reduced to suppress water evaporation and solvent component is increased, is used. By filling or loading such transporting ink within the recording head, at any time during the transportation and storage of the entire recording apparatus, the ink jet recording head can be maintained in a condition in which good recording performance can be achieved.

However, also in the recording apparatus in which such transporting ink is used, when the user initially uses the recording apparatus, an inconvenience, such as the recording performance is not completely normal, may occur. Occurrence of such inconvenience is based on a process for exchanging the transporting ink into the recording ink in the recording head by means of the recovery means of the recording apparatus when the user initially uses the recording apparatus and is based on non-smooth execution of such exchanging process. Namely, since the transporting ink has high viscosity for the purpose of suppression of water evaporation, flow of ink during suction is worsened in comparison with the recording ink, with the result that exchange from the transporting ink to the recording ink in the recording head is not effected smoothly or, if the exchange itself is effected smoothly, residual transporting ink adhered to the wiping means or the suction means is transferred to the recording head again to be adhered thereto. For these reasons, the inconvenience occurs.

SUMMARY OF THE INVENTION

An object of the present invention is to provide an ink jet recording apparatus in which transporting ink is positively exchanged into recording ink when the user initially uses the recording apparatus, and removal of residual transporting ink within recovery means can be promoted, and re-transferring of the residual transporting ink to a recording head can be prevented, and a method for handling such an ink jet recording apparatus. Further, an object of the present invention is to provide an ink jet recording apparatus in which a time for setting a recording head upon initial usage of the recording apparatus can be saved, inconvenience due to poor setting of the recording head can be avoided, a setting-up ability of the recording apparatus is enhanced, and poor recording quality due to transporting ink in an initial stage of usage of the recording apparatus can be avoided, and a method for handling such an ink jet recording apparatus.

Another object of the present invention is to provide an ink jet recording apparatus comprising a carriage for mounting a recording head for effecting recording by discharging recording ink and for moving the recording head, and recovery means for effecting a recovery operation with respect to the recording head, and wherein the recording apparatus is forwarded from a manufacturing factory in a condition that the recording head filled with transporting ink different from the recording ink is mounted on the carriage, and further wherein an on-arrival recovery mode executed by the recovery means upon first usage of the recording apparatus by the user differs from a normal recovery mode executed by the recovery means after the first usage.

A further object of the present invention is to provide an ink jet recording apparatus comprising a carriage for mounting a recording head for effecting recording by discharging recording ink and for moving the recording head, and recovery means for effecting a recovery operation with respect to the recording head, and wherein the recording apparatus is forwarded from a manufacturing factory in a condition that the recording head filled with transporting ink different from the recording ink is mounted on the carriage, and further wherein an on-arrival recovery mode executed by the recovery means upon first usage of the recording apparatus by the user is the same as a recovery mode executed upon exchange of the recording head among a plurality of recovery modes executed by the recovery means after the first usage.

A still further object of the present invention is to provide an ink jet-recording apparatus comprising a carriage for mounting a recording head for effecting recording by discharging-recording ink and for moving the recording head, and a mounting section for mounting an ink tank for storing the recording ink to be supplied to the recording head, and wherein the recording apparatus is forwarded from a manufacturing factory in a condition that the recording head filled with transporting ink different from the recording ink is mounted on the carriage, and further comprising detection means for detecting whether the ink tank is mounted on the mounting section, and alarm means for emitting an alarm to the user of the recording apparatus if the fact that the ink tank is not mounted on the mounting section upon first usage of the recording apparatus by the user is detected by means of the detection means.

A further object of the present invention is to provide a method for handling an ink jet recording apparatus comprising a carriage for mounting a recording head for effecting recording by discharging recording ink and for moving the recording head, and recovery means for effecting a recovery operation with respect to the recording head, the method comprising the steps of forwarding the ink jet recording apparatus from a manufacturing factory in a condition that the recording head filled with transporting ink different from the recording ink is mounted on the carriage, and executing an on-arrival recovery mode different from a normal recovery mode executed by the recovery means after first usage of the recording apparatus by the user by means of the recovery means upon the first usage, with respect to the recording head.

A still further object of the present invention is to provide a method for handling an ink jet recording apparatus comprising a carriage for mounting a recording head for effecting recording by discharging recording ink and for moving the recording head, and recovery means for effecting a recovery operation with respect to the recording head, the method comprising the steps of forwarding the ink jet recording apparatus from a manufacturing factory in a condition that the recording head filled with transporting ink different from the recording ink is mounted on the carriage, and executing an on-arrival recovery mode same as a recovery mode executed upon exchange of the recording head among a plurality of recovery modes executed by the recovery means after first usage of the recording apparatus by the user by means of the recovery means upon the first usage, with respect to the recording head.

Another object of the present invention is to provide a method for handling an ink jet recording apparatus comprising a carriage for mounting a recording head for effecting recording by discharging recording ink and for moving the recording head, and a mounting section for mounting an ink tank for storing the recording ink to be supplied to the recording head, the method comprising the steps of forwarding the ink jet recording apparatus from a manufacturing factory in a condition that the recording head filled with transporting ink different from the recording ink is mounted on the carriage, and emitting alarm to the user of the recording apparatus if the fact that the ink tank is not mounted on the mounting section upon first usage of the recording apparatus by the user is detected.

According to the present invention, there can be provided an ink jet recording apparatus in which the transporting ink is positively exchanged into the recording ink when the user initially uses the recording apparatus, and removal of residual transporting ink within the recovery means can be promoted, and re-transferring of the residual transporting ink to the recording head can be prevented, and a method for handling such an ink jet recording apparatus. Further, there can be provided an ink jet recording apparatus in which a time for setting the recording head upon initial usage of the recording apparatus can be saved, inconvenience due to poor setting of the recording head can be avoided, and a setting-up ability of the recording apparatus is enhanced, and poor recording quality due to transporting ink in an initial stage of usage of the recording apparatus can be avoided, and a method for handling such an ink jet recording apparatus.

By adopting an arrangement in which suction means for effecting suction from the recording head is provided as the recovery means and suction pressure of the suction means upon ink suction from the recording head in the on-arrival recovery mode is set to be higher than suction pressure upon ink suction in the normal recovery mode, or an arrangement in which suction means for effecting suction from the recording head is provided as the recovery means and a suction amount of the suction means upon ink suction from the recording head in the on-arrival recovery mode is set to be greater than a suction amount upon ink suction in the normal recovery mode, or arrangement in which suction means for effecting suction from the recording head is provided as the recovery means and the number of suction operations of the suction means upon ink suction from the recording head in the on-arrival recovery mode is set to be greater than the number of suction operations upon ink suction in the normal recovery mode, or an arrangement in which the on-arrival recovery mode is a mode wherein suction operations of one kind in the normal recovery mode are repeated continuously plural times, even the transporting ink which may have viscosity greater than that of the recording ink can well be suction-removed from the recording means, the exchange from the transporting ink to the recording ink in the recording head can be effected more positively, and deterioration of image quality due to mixing of the transporting ink and the recording ink in the recording head during the recording can be prevented more effectively.

By adopting an arrangement in which suction means for effecting suction from the recording head is provided as the recovery means and the number of idle suction operations for discharging the ink from a cap by driving the suction means in a communication condition between the interior of the cap and the atmosphere upon ink suction from the recording head by the suction means in the on-arrival recovery mode is set to be greater than the number of idle suction operations in the normal recovery mode, the transporting ink remaining within the cap can be discharged positively, and the interior of the cap can also be filled with the recording ink, and the residual transporting ink within the cap can be prevented from being transferred into the recording head again during the further capping and/or suction operations, and deterioration of image quality due to mixing of the transporting ink and the recording ink in the recording head during the recording can be prevented more effectively.

By adopting an arrangement in which suction means for effecting suction from the recording head and a wiper for wiping the recording head are provided as the recovery means and the number of wiping operations of the wiper after ink suction from the recording head by the suction means in the on-arrival recovery mode is set to be greater than the number of wiping operations of the wiper after ink suction in the normal recovery mode, the transporting ink remaining on the discharge port face of the recording head can be removed positively by the wiping operations, and deterioration of image quality due to mixing of the transporting ink and the recording ink in the recording head during the recording can be prevented more effectively.

By adopting an arrangement in which a wiper for wiping the recording head and a cleaner for cleaning the wiper are provided as the recovery means and the number of cleaning operations of the cleaner after the wiping of the wiper in the on-arrival recovery mode is set to be greater than the number of cleaning operations of the cleaner after the wiping in the normal recovery mode, when the discharge port face of the recording head is wiped, the residual transporting ink adhered to the wiper can be removed positively, and the residual transporting ink can be prevented from being transferred to the discharge port face of the recording head during further wiping, and deterioration of image quality due to mixing of the transporting ink and the recording ink in the recording head during the recording can be prevented more effectively.

By adopting an arrangement in which suction means for effecting suction from the recording head and a wiper for wiping the recording head are provided as the recovery means and, in the on-arrival recovery mode, after ink suction from the recording head is firstly effected by the suction means, by effecting the wiping of the wiper, since the process for exchanging from the transporting ink to the recording ink in the recording head is finished before the transporting ink is adhered to a new wiper and since the wiping operation is effected in a condition that the transporting ink is substantially removed from the discharge port face of the recording head and from the recording head, adhesion of the transporting ink onto the new wiper and the transferring of the residual transporting ink onto the discharge port face during the further wiping can be prevented, and good image quality can be maintained continuously from the initiation of usage of the recording apparatus.

By adopting an arrangement in which the viscosity of the transporting ink is greater than that of the recording ink or an arrangement in which the recording ink includes color material and the transporting ink does not include color material or has a color component less than that of the recording ink, even when the composition of the transporting ink is specialized in order to maintain the recording quality of the recording head, the poor recording quality due to the transporting ink in the initial stage of usage of the recording apparatus can be avoided.

Further, according to the present invention, there can be provided an ink jet recording apparatus in which exchange from the transporting ink to the recording ink can be effected positively when the user initially uses the recording apparatus, and removal of the residual transporting ink within the recovery means can be promoted, and re-transferring of the residual transporting ink onto the recording head can be prevented, and, even if the recording head is exchanged for any reason when the user initially uses the recording apparatus, the residual transporting ink within the recovery means can well be removed, and the poor recording quality due to the transporting ink in the initial stage of usage of the recording apparatus can be avoided, and a method for handling such as ink jet recording apparatus. Further, there can be provided an ink jet recording apparatus in which the ink tank for the recording ink can be set positively in the on-arrival recovery mode, the process for exchanging the transporting ink to the recording ink within the recording head can be effected more positively, and good recording quality can be maintained from the initiation of usage of the recording apparatus, and a method for handling such an ink jet recording apparatus.

By adopting an arrangement in which the transporting ink is heated by an ink temperature maintaining electrothermal converter within the recording head before or during the ink suction by the suction means in the on-arrival recovery mode, even when the transporting ink has viscosity greater than that of the recording ink, by reducing the viscosity of the transporting ink, the transporting ink can well be suctioned and removed from the recording head, and exchange from the transporting ink to the recording ink within the recording head can be effected more positively.

By adopting an arrangement in which the transporting ink is heated by an ink discharging electrothermal converter within the recording head before or during the ink suction by the suction means in the on-arrival recovery mode, even when the transporting ink has viscosity greater than that of the recording ink, by reducing the viscosity of the transporting ink by utilizing an existing ink discharging electrothermal converter, the transporting ink can well be suctioned and removed from the recording head, and exchange from the transporting ink to the recording ink within the recording head can be effected more positively.

By adopting an arrangement in which the transporting ink is heated by an ink temperature maintaining electrothermal converter and an ink discharging electrothermal converter within the recording head before or during the ink suction by the suction means in the on-arrival recovery mode, even when the transporting ink has viscosity greater than that of the recording ink, by reducing the viscosity of the transporting ink, the transporting ink can well be suctioned and removed from the recording head, and exchange from the transporting ink to the recording ink within the recording head can be effected more positively.

By adopting an arrangement in which the transporting ink is discharged by an ink discharging electrothermal converter within the recording head before or during the ink suction by the suction means in the on-arrival recovery mode, exchange from the transporting ink to the recording ink within the recording head can be effected more positively.

By adopting an arrangement in which the transporting ink is heated by an ink temperature maintaining electrothermal converter within the recording head and the transporting ink is discharged by an ink discharging electrothermal converter during the ink suction by the suction means in the on-arrival recovery mode, exchange from the transporting ink to the recording ink within the recording head can be effected more positively.

By adopting an arrangement in which the transporting ink is heated by an ink temperature maintaining electrothermal converter within the recording head from before the ink suction to the end of the ink suction by the suction means in the on-arrival recovery mode, even when the transporting ink has viscosity greater than that of the recording ink, by reducing the viscosity of the transporting ink, the transporting ink can well be suctioned and removed from the recording head, and exchange from the transporting ink to the recording ink within the recording head can be effected more positively.

By adopting an arrangement in which the transporting ink is heated by an ink discharging electrothermal converter within the recording head from before the ink suction to the end of the ink suction by the suction means in the on-arrival recovery mode, even when the transporting ink has viscosity greater than that of the recording ink, by reducing the viscosity of the transporting ink by utilizing the existing ink discharging electrothermal converter, the transporting ink can well be suctioned and removed from the recording head, and exchange from the transporting ink to the recording ink within the recording head can be effected more positively.

By adopting an arrangement in which the transporting ink is heated by an ink temperature maintaining electrothermal converter and an ink discharging electrothermal converter within the recording head from before the ink suction to the end of the ink suction by the suction means in the on-arrival recovery mode, even when the transporting ink has viscosity greater than that of the recording ink, by reducing the viscosity of the transporting ink, the transporting ink can well be suctioned and removed from the recording head, and exchange from the transporting ink to the recording ink within the recording head can be effected more positively.

By adopting an arrangement in which the transporting ink is discharged by an ink discharging electrothermal converter within the recording head from before the ink suction to the end of the ink suction by the suction means in the on-arrival recovery mode, even when the transporting ink has viscosity greater than that of the recording ink, by reducing the viscosity of the transporting ink, the transporting ink can well be suctioned and removed from the recording head, and exchange from the transporting ink to the recording ink within the recording head can be effected more positively.

By adopting an arrangement in which the transporting ink is heated by an ink temperature maintaining electrothermal converter and the transporting ink is discharged by an ink discharging electrothermal converter within the recording head from before the ink suction to the end of the ink suction by the suction means in the on-arrival recovery mode, even when the transporting ink has viscosity greater than that of the recording ink, by reducing the viscosity of the transporting ink, the transporting ink can well be suctioned and removed from the recording head, and exchange from the transporting ink to the recording ink within the recording head can be effected more positively.

By adopting an arrangement in which, when the transporting ink is heated and discharged by an ink discharging electrothermal converter within the recording head from before the ink suction to the end of the ink suction by the suction means in the on-arrival recovery mode, an input signal value, frequency, and ink color to be inputted and a discharge port can be selected appropriately and, by adopting an arrangement in which any input signal value, frequency and ink color can be inputted to the ink temperature holding electrothermal converter of the recording head, exchange from the transporting ink to the recording ink within the recording head can be effected more positively.

By adopting an arrangement including time counting means for counting an elapsed time from the forwarding, by optimizing a heating value and a suction condition, exchange from the transporting ink to the recording ink within the recording head can be effected more positively.

Since an arrangement including time reading means for reading the elapsed time from the forwarding is adopted, by optimizing the heating value and the suction condition, exchange from the transporting ink to the recording ink within the recording head can be effected more positively.

By adopting an arrangement including control means for judging and determining a heating amount of the recording head on the basis of the elapsed time from the forwarding, by optimizing the heating value, exchange from the transporting ink to the recording ink within the recording head can be effected more positively.

By adopting an arrangement including temperature history storing means for storing temperature history from the forwarding, by optimizing the heating value and the suction condition, exchange from the transporting ink to the recording ink within the recording head can be effected more positively.

By adopting an arrangement including temperature history reading means for reading temperature history from the forwarding, by optimizing the heating value and the suction condition, exchange from the transporting ink to the recording ink within the recording head can be effected more positively.

By adopting an arrangement including heating control means for judging and determining the heating amount of the recording head on the basis of the temperature history from the forwarding, by optimizing the heating value, exchange from the transporting ink to the recording ink within the recording head can be effected more positively.

By adopting an arrangement in which a heating temperature for each color can be set by the heating control means, by optimizing the heating value and the suction condition, exchange from the transporting ink to the recording ink within the recording head can be effected more positively.

By adopting an arrangement including storing means capable of re-writing and calling the elapsed time and the temperature history from the forwarding, correct information can always be maintained, and, by optimizing an ink discharging condition, heating amount and suction condition, exchange from the transporting ink to the recording ink within the recording head can be effected more positively.

By adopting an arrangement in which viscosity of the transporting ink is greater than that of the recording ink, reserving stability of the recording head can be enhanced.

DETAILED DESCRIPTION OF THE PREFERRED EMBODIMENTS

Figure 1:
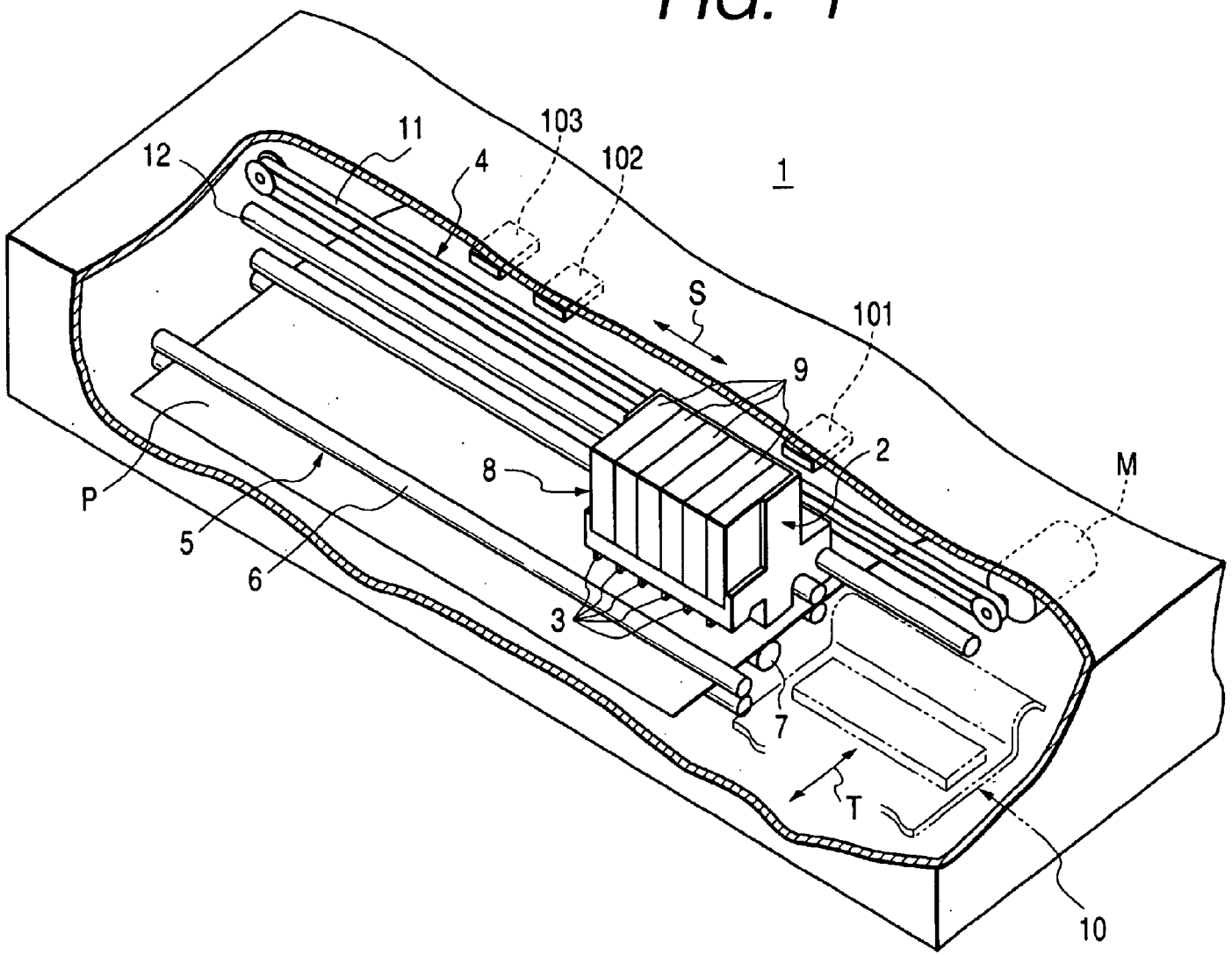
FIG. 1 is a fragmental schematic perspective view showing an embodiment of an ink jet recording apparatus to which the present invention is applied.

The present invention will be concretely explained in connection with embodiment thereof with reference to the accompanying drawings. Incidentally, in the Figures, the same reference numerals denote same or similar parts or elements. FIG. 1 is a fragmental schematic perspective view of an ink jet recording apparatus having recovery means according to the present invention, FIG. 2 is a schematic top perspective view of wiping means (recovery means) of a recovery system of the ink jet recording apparatus of FIG. 1, and FIG. 3 is a schematic side view showing a condition before a wiping operation of the wiping means constituting recovery means of the recovery system of the ink jet recording apparatus (ink jet recording apparatus of FIG. 1) according to the present invention.

Figure 2:
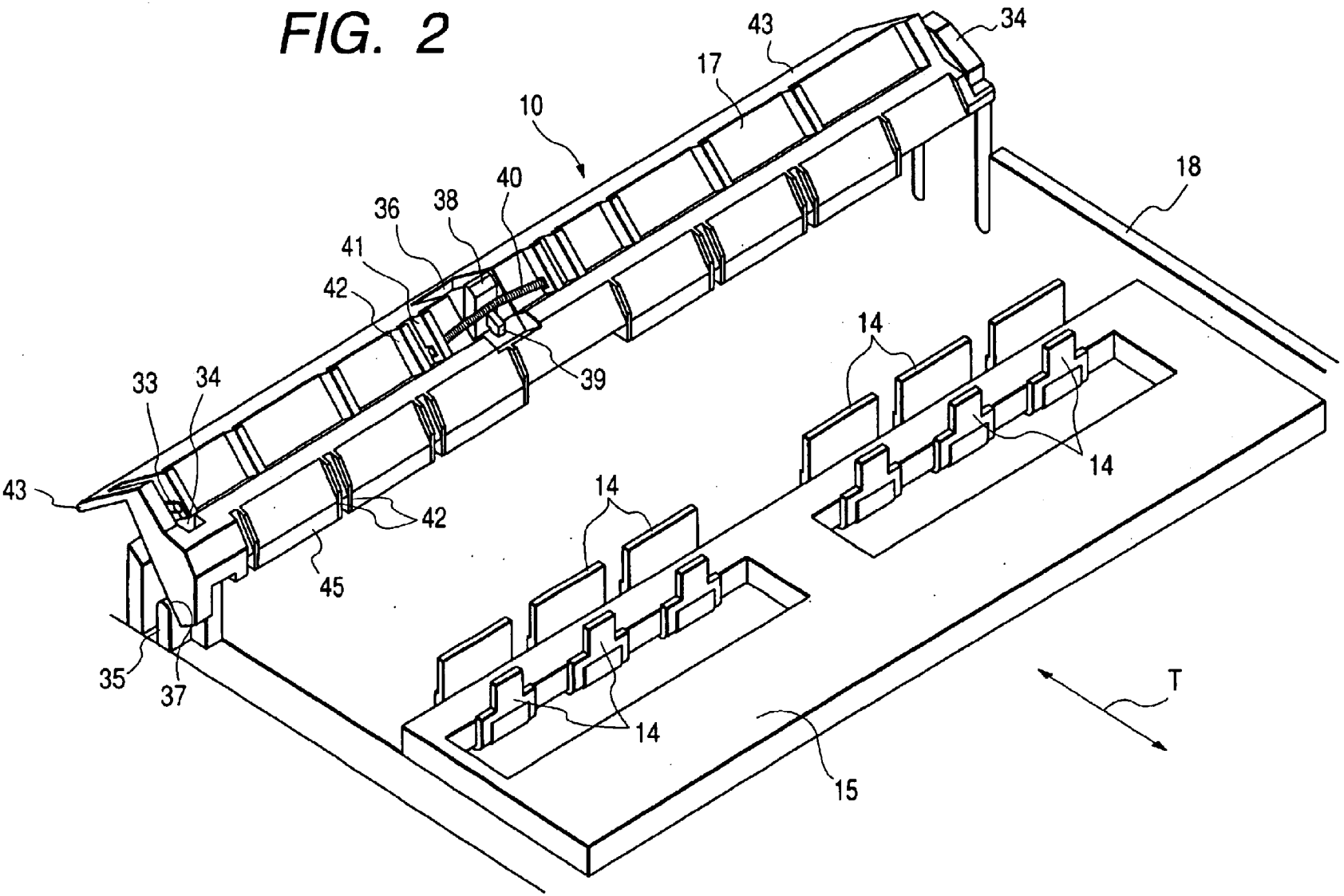
FIG. 2 is a schematic top perspective view of wiping means of a recovery system of the ink jet recording apparatus of FIG. 1.
Figure 3:
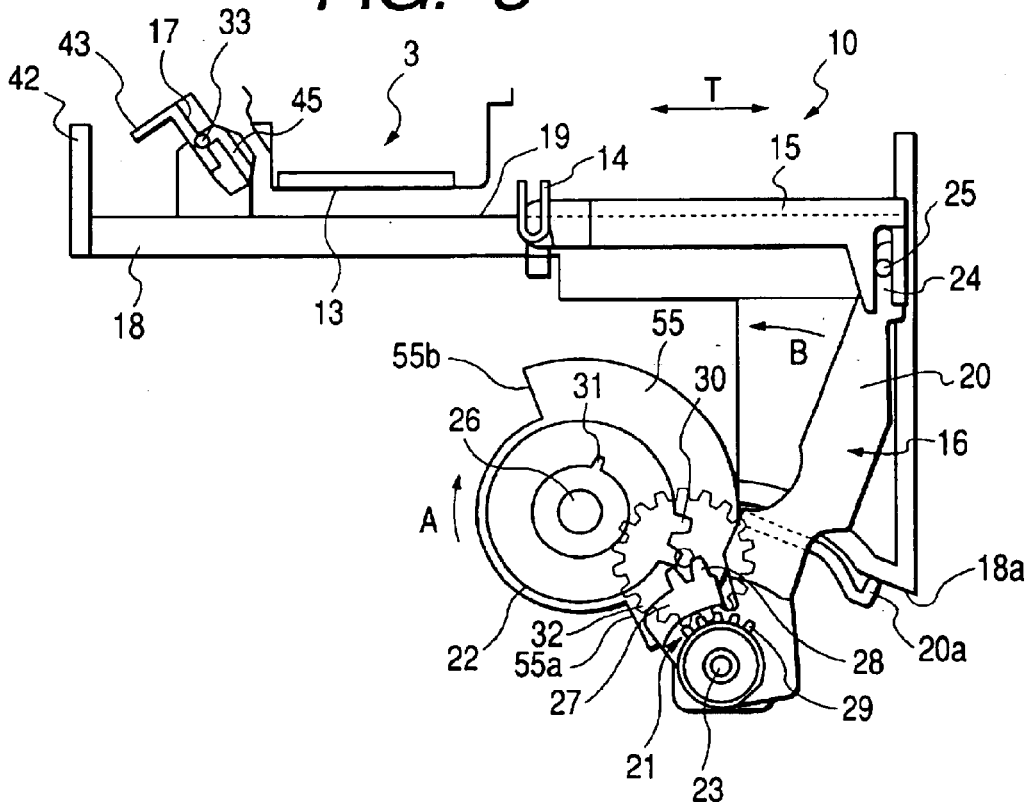
FIG. 3 is a schematic side view showing a condition before a wiping operation of wiping means (recovery means) according to an embodiment of an ink jet recording apparatus to which the present invention is applied is started.

In FIGS. 1 to 3, an ink jet recording apparatus 1 includes a driving motor M as a drive source, a carriage 2 on which ink jet recording heads 3 as recording means are mounted, a transmitting mechanism 4 for reciprocally moving the carriage 2 by means of the driving motor M, a sheet feeding mechanism (paper feeding mechanism) 5 for conveying (feeding) a recording paper P as a recording medium, and a recovery system 10 for maintaining and recovering ink discharging performance of the recording heads 3. The recovery system 10 is constituted by single or plural recovery means, for example, wiping means and suction means which will be described later, or the wiping means or the suction means. The wiping means is designed to wipe (clean) discharge port faces of the recording heads (recording means) 3 by means of wipers, and the suction means is designed to refresh ink within discharge ports by sucking the ink from the discharge ports of the recording heads 3. In such an ink jet recording apparatus 1, the recording paper P is fed-in by a sheet feeding roller 6 of the sheet feeding mechanism 5, and predetermined recording is effected on the recording paper P by the recording heads 3 on a platen 7.

The recording heads 3 can be mounted on the carriage 2, and ink tanks 9 can be mounted on the recording heads 3. Inks contained in the ink tanks 9 are supplied to the recording heads 3. In this case, the carriage 2 and the recording heads 3 are properly contacted with each other at their interfaces to achieve required electrical connection. Within the ink jet recording apparatus 1, there is provided storing means 101 for storing information such as an elapsed time (for example, elapsed time from forwarding from a manufacturing factory) and/or temperature history of the recording apparatus 1 or the recording heads 3, and reading of a detection value of temperature detection means 102 such as a temperature thermistor, and storing, calling and re-writing of a count value of time counting means 103 can be effected.

When the ink jet recording apparatus is forwarded from the manufacturing factory, the recording heads 3 were already mounted on the carriage 2, and the transporting ink was filled within the recording heads 3 as the recording means. On the other hand, the ink tanks 9 are not mounted on the recording heads 3, but are packed separately and are housed in a product package together with the ink jet recording apparatus.

The recording head. 3 is recording means (ink jet recording head) in which the recording is effected by selectively discharging the ink from the plural discharge ports by applying energy in response to a recording signal. Further, the recording head 3 is recording means adapted to discharge the ink by utilizing thermal energy and having ink discharging electrothermal converters for generating the thermal energy. Further, the recording head 3 serves to effect the recording by discharging the ink from the discharge port by utilizing pressure change based on growth and contraction of a bubble created by film boiling generated by the thermal energy from the electrothermal converter. The electrothermal converters are provided in association with the respective discharge ports, and the ink is discharged from the corresponding discharge port by applying pulse voltage to the corresponding electrothermal converter in response to the recording signal.

Figure 18:
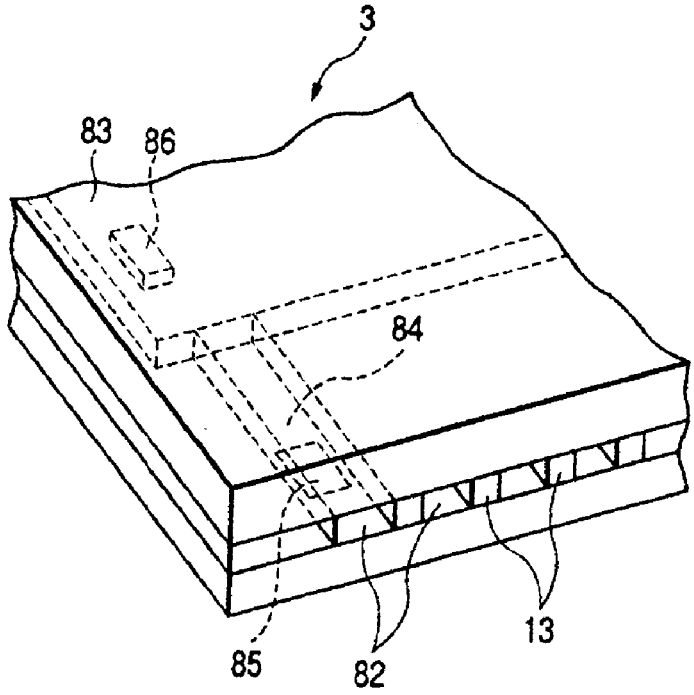
FIG. 18 is a partial perspective view schematically showing a construction of an ink discharge portion of the recording head of FIG. 1.

FIG. 18 is a partial perspective view schematically showing a construction of an ink discharge portion (one array of discharge ports) of the recording head 3. In FIG. 18, a plurality of discharge ports 82 are formed in a discharge port face 13 opposed to the recording medium (recording paper and the like) P with a predetermined gap (for example, about 0.3 to 2.0 mm) therebetween at a predetermined pitch, and ink discharging electrothermal converters (heat generating resistance bodies) 85 for generating ink discharging energy are provided along wall surfaces of respective liquid paths 84 for communicating the respective discharge ports 82 with a common liquid chamber 83. The recording head 3 is guided and supported in such a manner that the discharge ports 82 are arranged along a direction perpendicular to a main scan moving direction (moving direction of the carriage 2 in the illustrated embodiment in which the recording head is mounted on the carriage 2).

In this way, the recording head 3 is designed so that the ink droplet is discharged from the discharge port 82 by the pressure generated by the film boiling in the ink within the liquid path 84 caused by driving (applying pulse voltage to) the corresponding electrothermal converter 85 in response to the image signal or discharge signal. Further, an ink temperature maintaining electrothermal converter (heat generating resistance body) 86 is within the common liquid chamber 83 of the recording head 3, and the ink temperature maintaining electrothermal converter 86 serves to maintain the ink temperature to maintain ink discharging performance and ink discharging stability by driving (applying pulse voltage to) the electrothermal converter 86 in accordance with external temperature environment around the recording apparatus.

Figure 19:
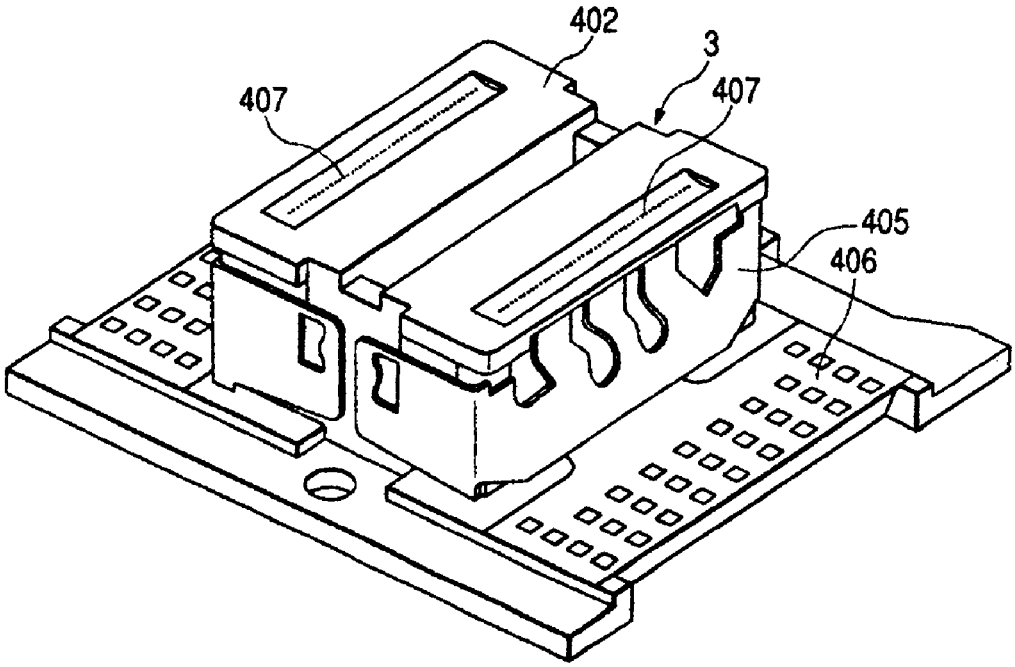
FIG. 19 is a schematic perspective view showing appearance of an embodiment of a recording head (ink jet head) used in the ink jet recording apparatus to which the present invention is applied.

FIG. 19 is a schematic perspective view showing appearance of an embodiment of the recording head (ink jet head) 3 used in the ink jet recording apparatus to which the present invention is applied. In FIG. 19, the recording head includes a resin molded portion 402, a spring member 405, a wiring substrate 406, and discharge port arrays 407. Each discharge port array 407 includes a plurality (predetermined number) of discharge ports 82, and, in a recording apparatus in which the recording is effected by using plural different inks, the number of discharge port arrays corresponding to the number of ink kinds are provided. Further, within the recording head 3, there is provided storing means 408 (not shown) for storing information such as an elapsed time (for example, elapsed time from forwarding from a manufacturing factory) and/or temperature history of the recording head 3, and reading of a detection value of temperature detection means 409 (not shown) such as a temperature thermistor provided on the recording head 3, and storing, calling and re-writing of a count value of time counting means 103 can be effected.

In FIG. 19, the discharge port arrays 407 are formed in the resin molded portion 402 and are dynamically urged against a silicon substrate (not shown) having energy generating elements (electrothermal converters) 85 and connected to the wiring substrate 406 by the spring member 405, thereby aligning and closely contacting the discharge port 82 forming portions with the electrothermal converters 85 with high accuracy. Further, an air-tight state is maintained by applying adhesive into gaps between the discharge port forming portions and the electrothermal converters. Resin near the discharge port arrays 407 of the resin molded portion 402 is subjected to water repelling treatment, thereby preventing factors (such as useless ink and dirt) which worsen the ink discharging from approaching the discharge port arrays 407. Further, hydrophilic sections are provided at locations appropriately spaced apart from the discharge port arrays 407 to trap useless matters such as ink remaining on the discharge port face 81.

Further, by connecting contact pads provided on the wiring substrate 406 with electrical contacts provided on the carriage, desired image formation (recording) can be effected by discharging the ink from the discharge port 82 in response to the electrical signal (recording data and the like) applied to the recording head synchronously with the scanning of the recording head 3. In the above description, while an example that the recording head 3 as the recording means is the ink jet head of thermal type using the resin 402 and the spring 405 was explained, the present invention can be applied to all types of ink jet heads such as an ink jet head of the type using electrothermal converters such as piezoelectric elements or an ink jet head of the type in which discharge ports are formed by a photo-lithography process, thereby achieving the similar effect.

In FIG. 1, the carriage 2 is connected to a part of a driving belt 11 of the transmitting mechanism 4 for transmitting the driving force of the driving motor M and is slidingly supported for a guiding movement in the main scanning direction along two (or single) guide shafts 12 disposed in parallel to each other and is driven by the driving motor M. Accordingly, the carriage 2 is reciprocally shifted along the guide shafts 12 by normal and reverse rotations of the driving motor M. In the illustrated ink jet recording apparatus 1, the platen 7 is disposed in a confronting relationship to the discharge port faces 13 in which the discharge ports of the recording heads 3 are formed, and the recording is effected on the entire width of the recording paper P as the recording medium conveyed onto the platen 7, by reciprocally moving the carriage 2 on which the recording heads 3 are mounted by the driving force of the driving motor M and, at the same time, by discharging the ink by applying the recording signals to the recording heads 3.

Further, in such an ink jet recording apparatus 1, the recovery system (recovery means) 10 for recovering the poor discharging of the recording heads 3 and for maintaining the discharging performance is provided at a desired position (for example, position corresponding to the home position) out of a reciprocal movement range (out of recording area) for the recording operation of the carriage 2 on which the recording heads 3 are mounted. In the illustrated embodiment, such a recovery system 10 is constituted by two recovery means, i.e., wiping means (recovery means) and suction means (recovery means) which will be described later.

The suction means includes a cap (cap member) for capping the discharge port faces 13 of the recording heads 3. In synchronism with the capping of the cap against the discharge port faces 13, the ink is forcibly discharged from the discharge ports by the suction means (suction pump and the like) as the recovery means, thereby effecting discharge recovery treatment for removing viscosity-increased inks and/or bubbles in the ink flow paths of the recording heads 3. Incidentally, in a non-recording condition, by capping the discharge port faces 13 of the recording heads 3, the recording heads can be protected and the ink can be prevented from being dried. Further, the wiping means is designed to wipe and remove the ink adhered to the discharge port faces and other foreign matters by wiping the discharge port faces 13 of the recording heads 3 by the wipers.

In FIGS. 1 to 3, the wiping means as the recovery means constituting the recovery system 10 includes blades as the wipers for wiping (wipe-cleaning) the discharge port faces 13 of the recording heads 3, a blade holder 15 adapted to support the blades 14 and shiftable along a guide member 19 (FIG. 3), an operating mechanism 16 for reciprocally moving the blade holder 15. Each of the wipers (blades) 14 for wiping the discharge port faces 13 of the recording heads 3 is formed from elastic material such as rubber and held at one end of the blade holder 15 as shown. The wipers 14 constitute the wiping means as the recovery means of the recovery system 10 and are connected to a motor as a drive source by a transmitting mechanism (driving mechanism). By slidably moving the wipers 14 while urging them against the discharge port faces 13 of the recording heads 3, the foreign matters such as ink adhered to the discharge port faces are removed (wipe-cleaned, wiped). Incidentally, in the illustrated embodiment, the suction means (described later) as the other recovery means constituting the recovery system 10 is also driven by the drive source (motor) common to that of the wiping means.

Namely, after the recording is effected by the recording heads 3, by positioning the recording heads 3 at the home position and by driving the wiping means of the recovery means 10 to slidingly shift the wipers 14 while urging them against the discharge port faces 13, adhered, dewy or wetted ink on the discharge port faces and/or dirt such as paper powder can be wiped and removed, thereby cleaning the discharge port faces 13 of the recording heads 3.

In FIGS. 1 to 3, the carriage 2 on which the recording heads 3 are mounted is reciprocally shifted in the main scanning direction shown by the double-headed arrow S in FIG. 1. The wiping means forming a part of the recovery system 10 is located in the vicinity of the home position of the recording heads 3 in order to wipe the discharge port faces 13 of the recording heads 3 on the carriage 2. The wiping means as the recovery means of the recovery system 10 of the ink jet recording apparatus to which the present invention is applied includes the wipers (blades) 14, the blade holder 15 adapted to support the wipers 14 at its one end and reciprocally shiftable in directions (front-and-rear directions) shown by the double-heated arrow T along the guide member 19 of the base 18, the operating mechanism 16 for reciprocally moving the blade holder 15, and a cleaner (blade cleaner) 17 rotatable to clean the wipers (blades) 14.

The blades (wipers) 14 are attached to the blade holder 15, and the blade holder 15 is guided to be translated (reciprocally shifted) in a left-and-right direction in FIG. 3 along the guide member 19 of the base 18 supporting various parts. Each of the illustrated blades 14 has a U-shaped cross-section so that the discharge port face 13 of the recording head 3 is wiped by the two bifurcated tip ends. However, the shape of the blade is not limited to the illustrated one, and a single blade or three or more blades may be used independence upon the shape and performance of the recording head 3. Further, other than the U-shaped blade, for example, a plurality of blades 14 may be arranged at a predetermined interval. Further, for example, the blade 14 is formed from rubber elastic material such as synthetic rubber or silicon rubber or plastic material having required elasticity. The blade holder 15 has a flat rectangular plate-shape and has two openings, and the number of blades (wipers) 14 corresponding to the number of recording heads 3 (six in the illustrated embodiment) are mounted on the blade holder, and the blade holder is reciprocally shifted in the directions T by the operating mechanism 16 along the guide member 19 of the base 18.

FIG. 3 shows a driving mechanism for the wiping means of the recovery system 10. In FIG. 3, the operating mechanism 16 for reciprocally moving the blade holder 15 is rotatably supported by the base 18 via pivot shaft 23 and includes a blade arm 20 having one end connected to the blade holder 15, and a gear mechanism 21 for transmitting a pivoting force to the blade arm 20 from a drive gear 22 driven by a driving motor (not shown). Connection of the blade arm 20 to the blade holder 15 is effected by engagement between an elongated slot 24 of the blade holder 15 and a pin 25 provided at a tip end of the blade arm 20.

The gear mechanism 21 for transmitting the driving force of the driving motor to the blade arm 20 includes the drive gear 22 driven by the motor (not shown), and a driven gear 27 for pivoting the blade arm 20. The driven gear 27 is constituted by a forward movement gear member 28 for effecting a forward movement of the blade holder 15, and a rearward movement gear member 29 for effecting a rearward movement of the blade holder 15, which members 28, 29 are integrally attached to the pivot shaft 23 for rotatably supporting the blade arm 20. The drive gear 22 driven by the driving motor includes a gear member 30 meshed with the forward movement gear member 28, a gear member 31 meshed with (connected to) the rearward movement gear member 29 via an idle gear 32 to drive the rearward movement gear member 29 reversely, and a light shielding portion 55, which gear members 30, 31 correspond to the gear members 28, 29 of the driven gear 27. An optical sensor 54 is secured to the base 18, and the optical sensor 54 is turned ON/OFF under the action of the light shielding portion 55 upon rotation of the drive gear 22.

Further, the gear members 28, 29 at the blade arm 20 side and the gear members 30, 31 at the drive gear 22 side have toothed portions at required locations in order to transmit the driving force to the blade arm 20 only when required. When the drive gear 22 is rotated in one direction, the blade arm 20 is reciprocally rotated, thereby reciprocally translating the blade holder 15 and the wiper blades 14 via the elongated slot 24 and the pin 25. With this driving mechanism, by appropriately selecting the driving frequency of the driving motor, only one directional rotation of the driving motor and the drive gear 22 causes the blade holder 15 and the wipers (blades) 14 to shift at any speed in forward and rearward movements.

In FIGS. 2 and 3, the cleaner (blade cleaner) 17 for wiping and cleaning the ink adhered to the wipers (blades) 14 is rotatably supported by the base 18. The cleaner 17 has a substantially mountain-shaped cross-section and is provided at its both ends with shaft portions 33. The cleaner 17 is rotatably mounted by fitting the shaft portions 33 into bearing portions 34 on both sides of the base 18. On the other hand, the base 18 is provided with a stopper 35 permitting one directional rotation of the cleaner 17 and inhibiting rotation of the cleaner in the other direction. The stopper 35 serves to prevent further rotation (clockwise rotation around the shaft portions 33 in FIG. 3) of the cleaner 17 by abutting an abut portion 37 of the cleaner 17 against the stopper.

Figure 8A:
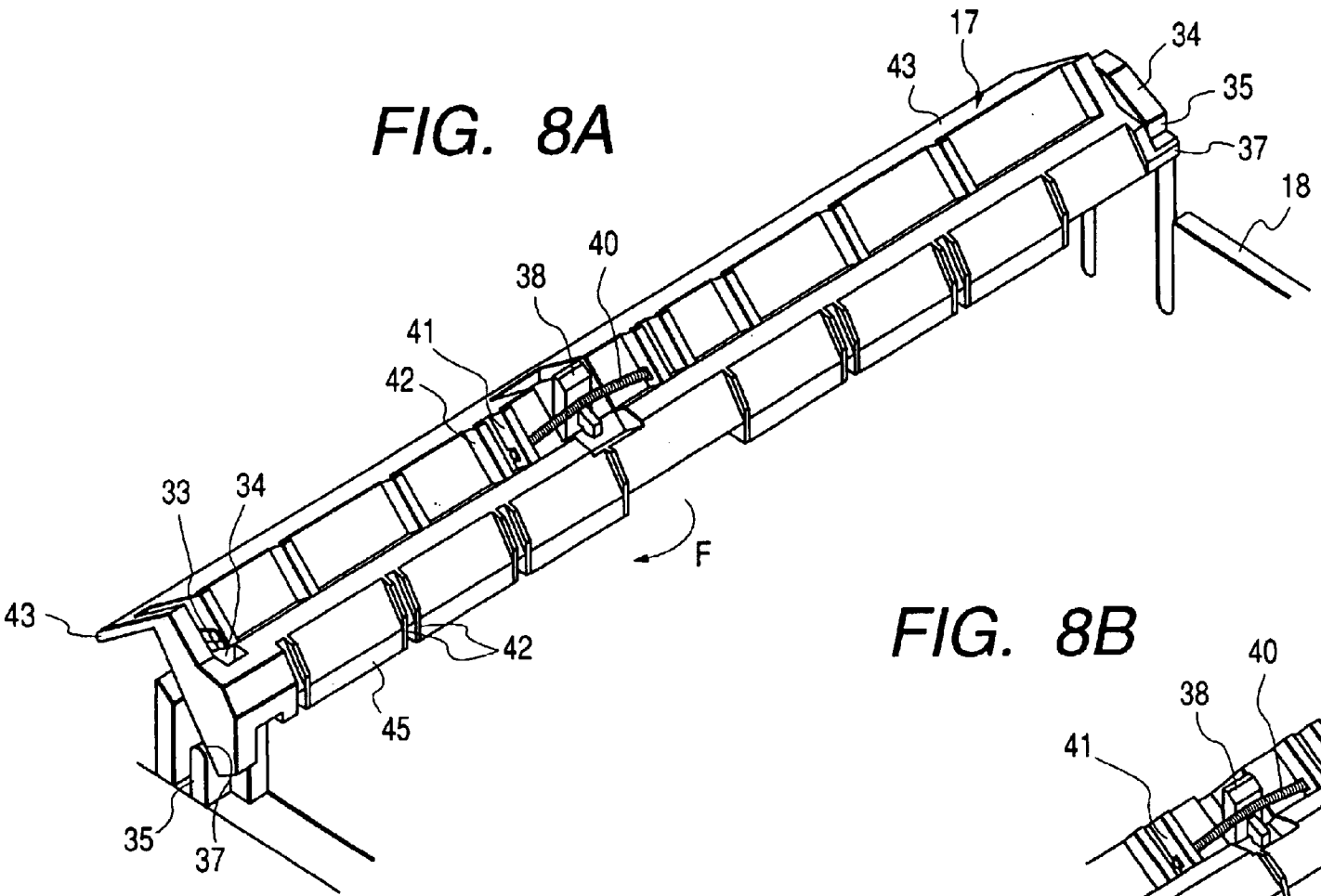
FIG. 8A is a schematic perspective view showing a condition that a cleaner for cleaning the wiper of FIG. 2 is operated.
Figure 8B:
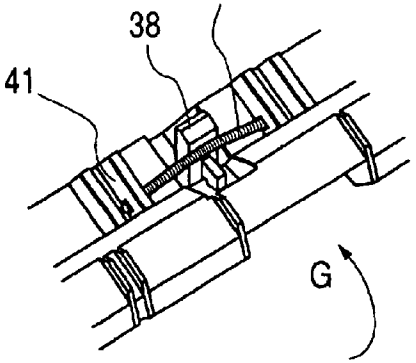
FIG. 8B is a schematic perspective view showing a central part of the cleaner when the cleaner is rotated in an inoperative position.

FIG. 8A is a schematic perspective view showing an operating condition of the cleaner, and FIG. 8B is a schematic perspective view showing a central part of the cleaner when the cleaner 17 is rotated in an inoperative position. In FIGS. 2, 8A and 8B, the central part of the cleaner (blade cleaner) 17 for effecting the cleaning of the wipers 14 is provided with a notched portion 36 into which a post 38 from the base 18 extends. The post 38 serves to support the central part of the elongated cleaner 17 to reduce rotational load thereof by contacting with an area near the rotational center of the cleaner 17 from above. To this end, a contact portion 39 of the post 38 at the central part of the cleaner 17 is tapered as a rib.

A spring 40 is provided for biasing the cleaner 17 to abut against the stopper 35. The spring 40 is constituted by a tight contact coil spring which corresponds to a normal tight contact coil tension spring from which both end hook portions are removed. Such a spring 40 is rested on the post 38 at the central part of the cleaner 17 and has both ends inserted into attaching portions 41 provided on walls 42 of the cleaner 17. Both ends of the spring 40 are mounted in the attaching portions 41 provided on the walls 42 of the cleaner (blade cleaner) 17 so that the spring cannot be moved in axial and radial directions exceeding predetermined play, but rotation of the spring is not regulated to permit slight rotation of the spring.

Further, since the spring 40 is located above the rotational center of the blade cleaner 17, as shown in FIG. 8B, when the cleaner 17 is rotated in a direction shown by the arrow G, the attaching portions 41 of the cleaner 17 are further spaced apart from the post 38 to increase the height of the mountain shape of the spring 40 to increase a deformed amount of the spring 40, thereby increasing a reaction force of the spring 40. Further, the cleaner (blade cleaner) 17 having the substantially mountain-shaped cross-section is provided with a hood-shaped screen 43 for preventing upward scattering of the ink, thereby preventing the scattering of the ink effectively and preferably.

Figure 10:
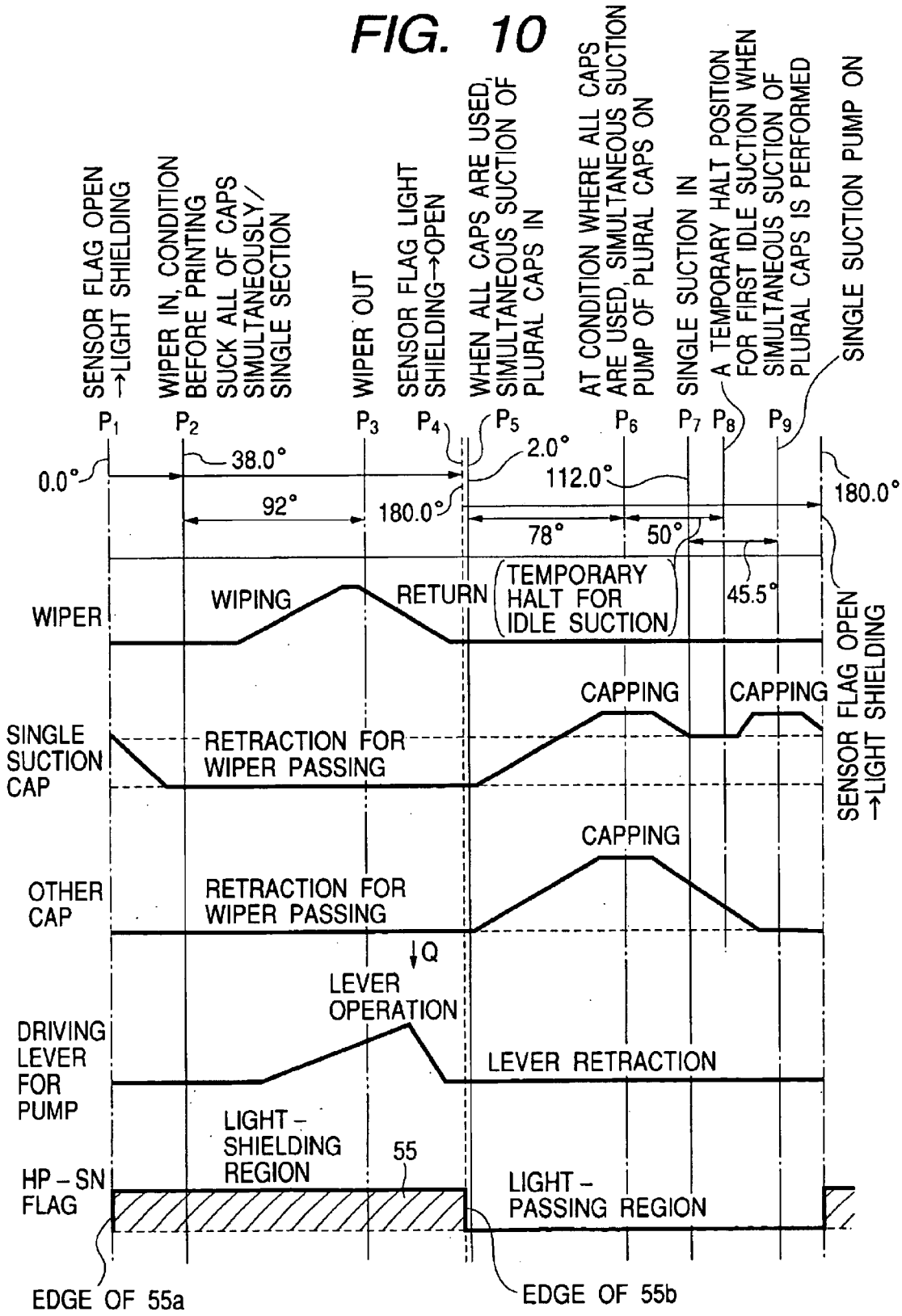
FIG. 10 is a cam diagram showing a relationship between phases of the cam and operations in the recovery system according to the embodiment of the present invention to which the present invention is applied.

In FIG. 3, upper ends of the wiper (blade) 14 of the wiping means of the recovery system 10 is raised above lower surfaces of the discharge port face 13 of the recording apparatus land the cleaner 17 by predetermined amounts (for example, about 0.1 mm to 2.0 mm), thereby providing predetermined overlap margins (interference margins). Further, in order to rotate the cleaner 17 lightly, the bearing portions (34 in FIG. 2) have slightly great play (for example, about 0.05 mm to 0.5 mm). FIG. 10 shows a cam diagram, where the abscissa indicates a cam angle and the numerical values represent angle values of the cam as a reference of an edge 55*a* of a flag 55 when a light passing condition is changed to a light shielding condition.

Figure 4:
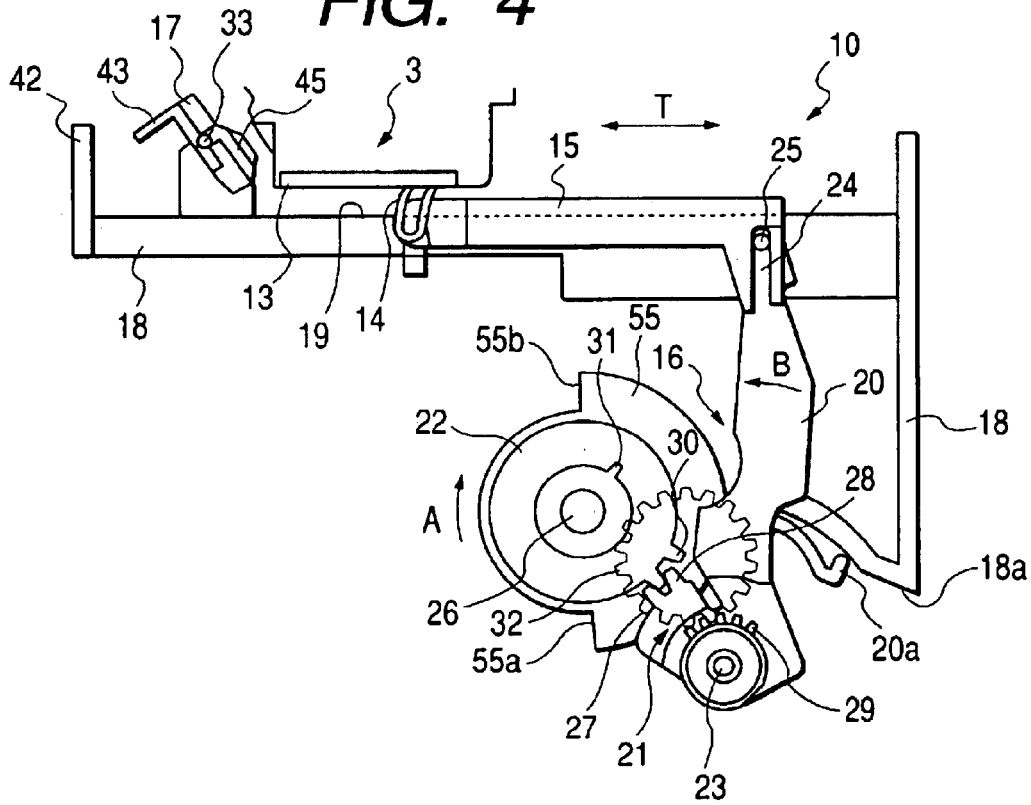
FIG. 4 is a schematic side view showing a condition that the wiping operation of the wiping means of FIG. 3 is effected.
Figure 5:
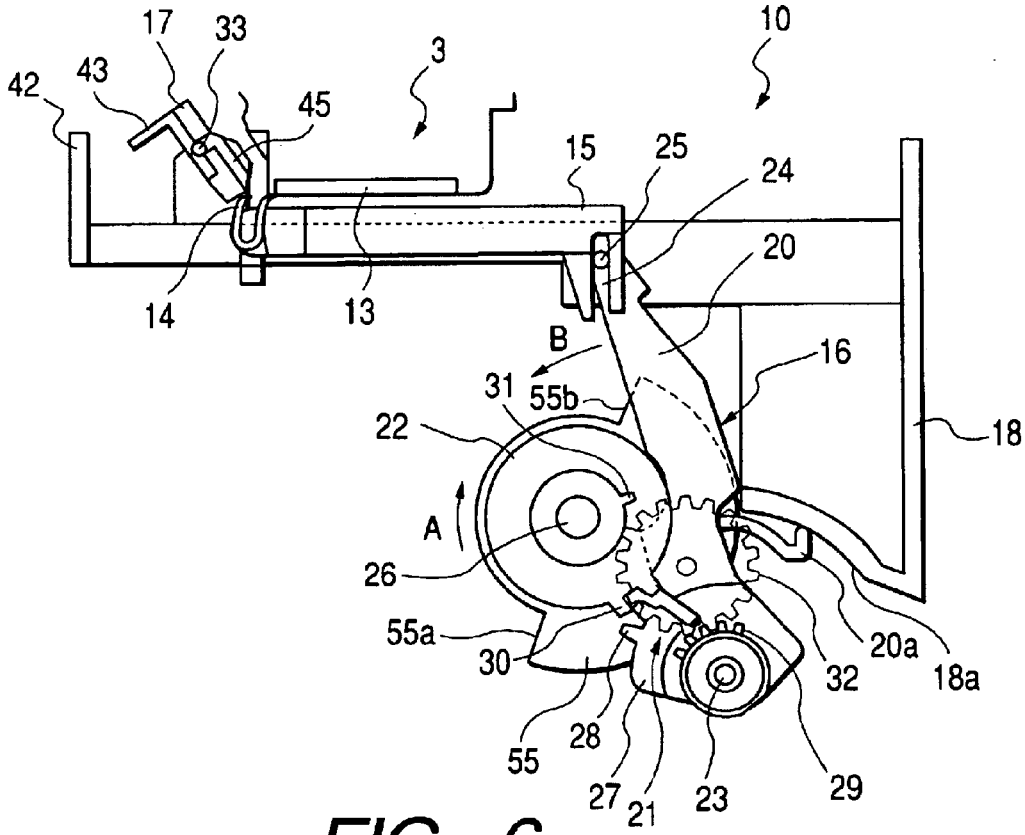
FIG. 5 is a schematic side view showing a condition that the wiping operation of the wiping means of FIG. 3 is finished.
Figure 6:
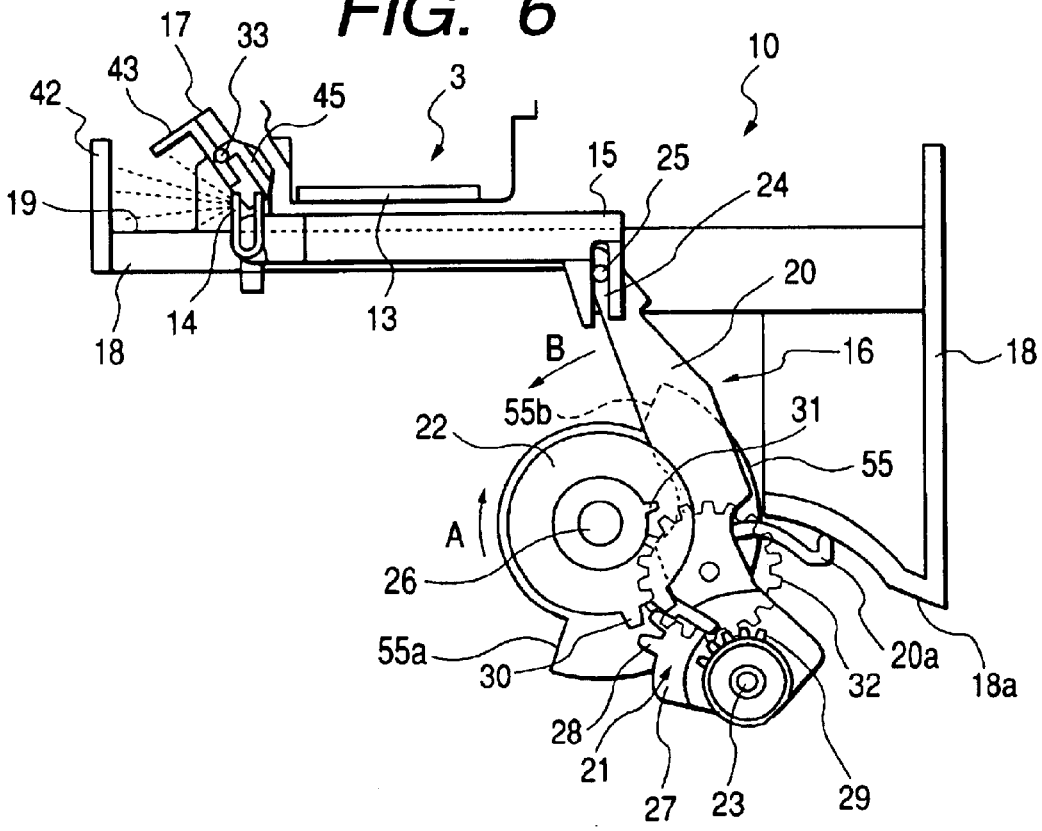
FIG. 6 is a schematic side view showing a condition that a wiper is cleaned after the wiping operation of the wiping means of FIG. 3 is finished.
Figure 7:
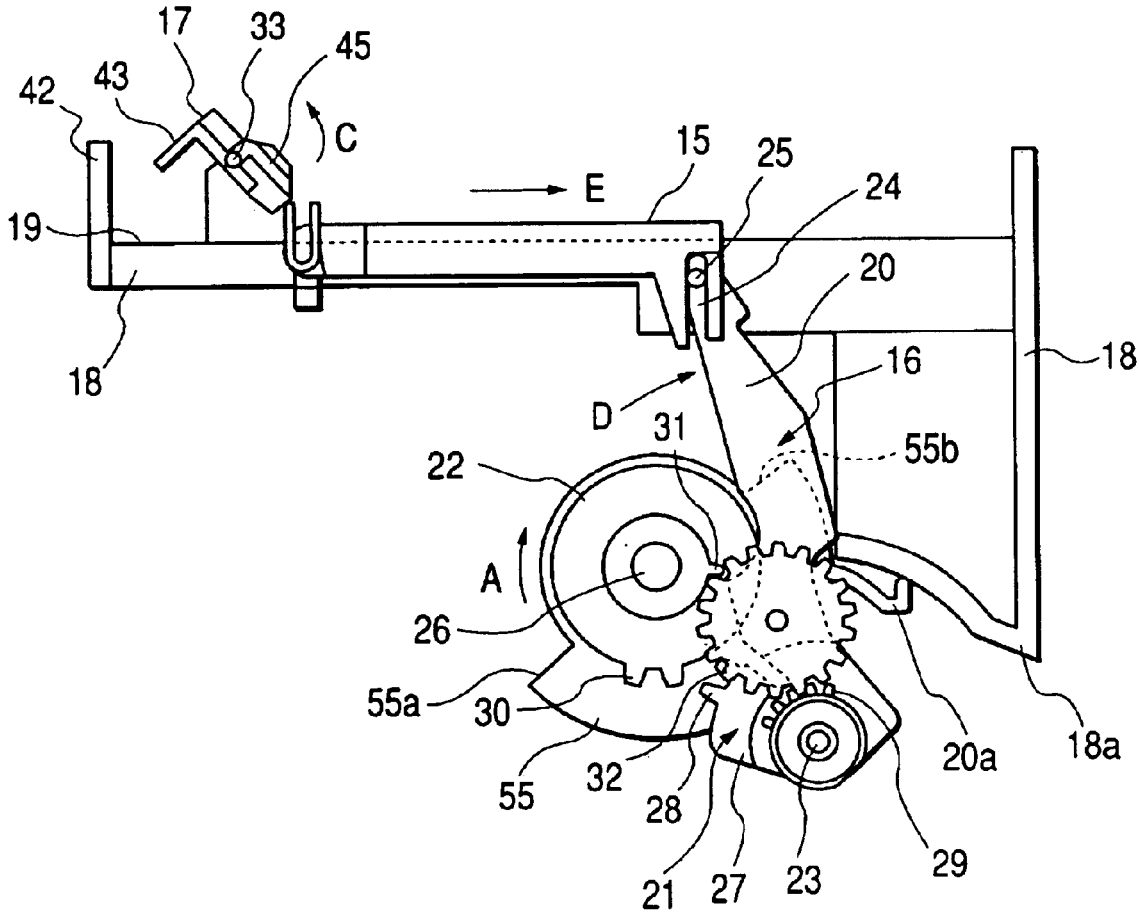
FIG. 7 is a schematic side view showing a condition that a wiper holder is restored after the wiper is cleaned in the wiping means of FIG. 3.

FIG. 4 is a schematic side view showing a condition (wiping operation condition) that the discharge port face 13 is being wiped by the wiping means (recovery means) of the recovery system 10 of the ink jet recording apparatus to which the present invention is applied, FIG. 5 is a schematic side view showing a condition (wiping operation finish condition) that the wiping operation of the wiping means of FIG. 4 against the discharge port face 13 is finished, FIG. 6 is a schematic side view showing a condition (blade cleaning condition) that the wiper is cleaned by the cleaner after the wiping operation of the wiping means of FIG. 4 against the discharge port face 13 is finished, and FIG. 7 is a schematic side view showing a condition (blade holder restoring condition) that the blade holder 15 is restored after the wiper 14 is cleaned by the wiping means of FIG. 4. Now, the operation (particularly, operations associated with the wiper 14) of the wiping means (recovery means) of the recovery system 10 of the ink jet recording apparatus according to the present invention will be explained with reference to FIGS. 3 to 7.

First of all, by moving the wiper (blade) 14 from the condition of FIG. 3 to the left in FIG. 3, as shown in FIG. 4, the ink and contaminants adhered to the discharge port face 13 of the recording head 3 are wiped, thereby cleaning the discharge port face 13. That is to say, when the blade holder 15 is shifted forwardly in the direction T along the guide member 19 of the base 18, the discharge port face 13 of the recording head 3 is wiped by the tip ends of the wiper 14, thereby cleaning the ink and contaminants adhered to the discharge port face 13. Namely, the discharge port face 13 is wiped and cleaned.

Figure 9:
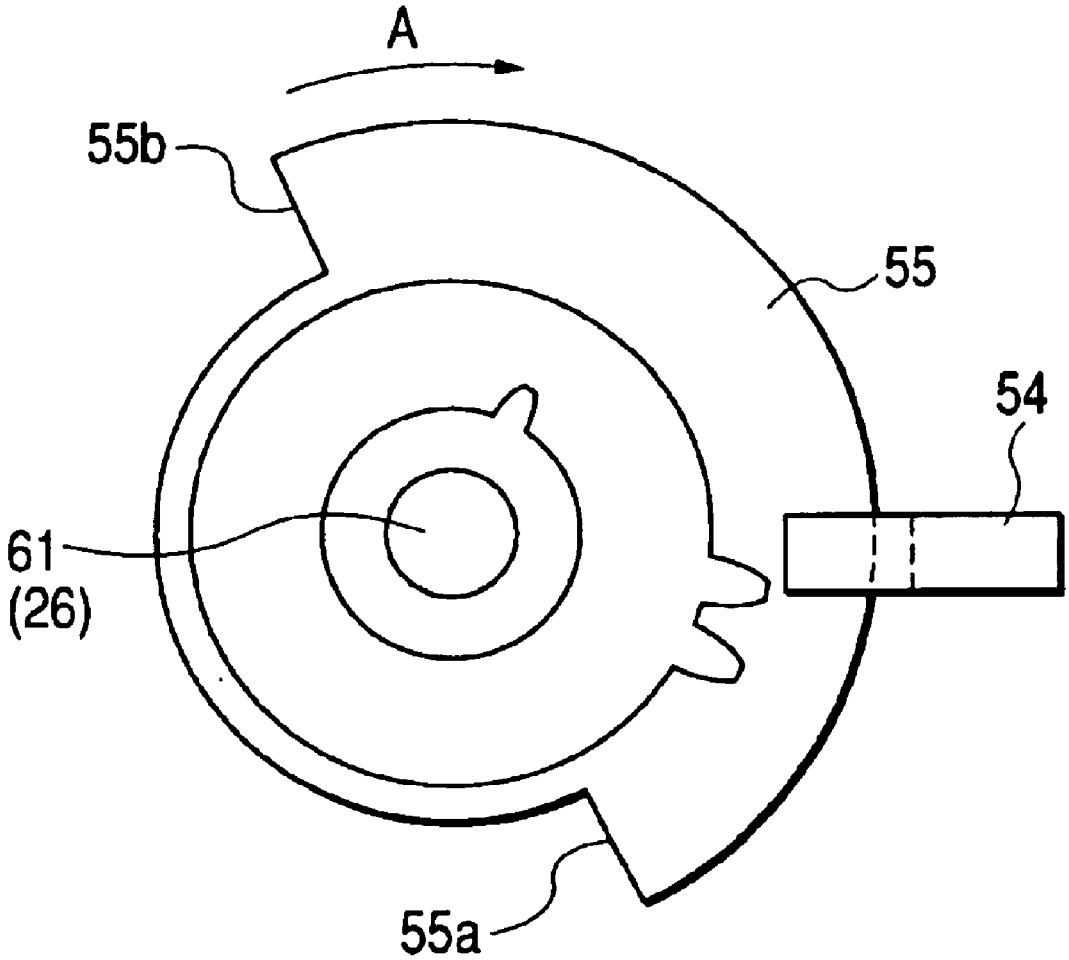
FIG. 9 is a partial front view showing a positional relationship between a flag coaxial with a cam of the recovery system according to an embodiment of the present invention to which the present invention is applied and an optical sensor.
Figure 11:
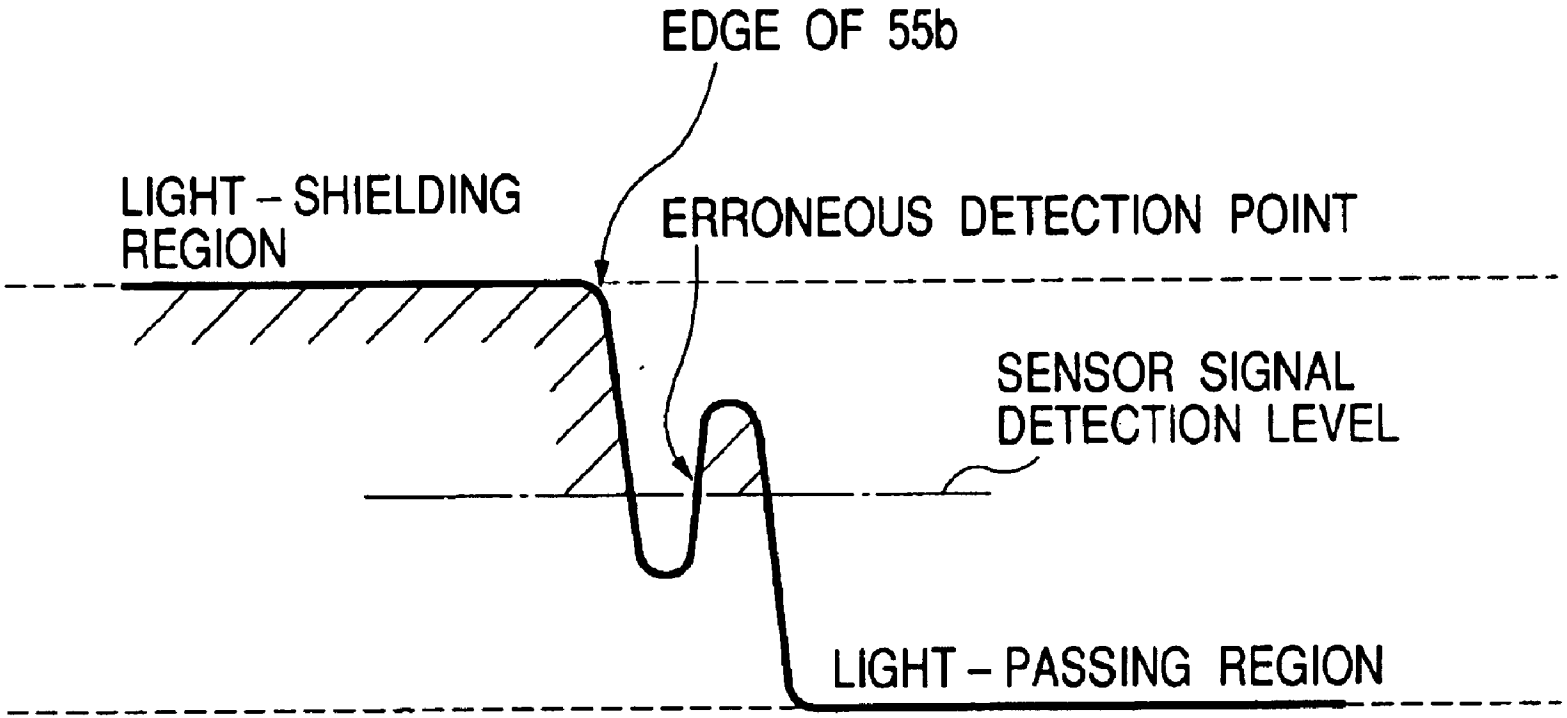
FIG. 11 is a schematic view showing a sensor signal in light shielding and light passing conditions at an edge, which may cause error detection of the flag of FIG. 9.

FIG. 9 is a partial front view showing a positional relationship between the flag (light shielding portion) 55 attached to a cam shaft 61 in the driving mechanism of the recovery system 10 of the ink jet recording apparatus to which the present invention is applied and the optical sensor 54, FIG. 10 is a cam diagram showing a relationship between phases of the cam of the recovery system 10 of the ink jet recording apparatus to which the present invention is applied and operations, and FIG. 11 is a schematic view showing an exemplary sensor signal in light passing and light shielding conditions at the edge which may cause error detection of the flag (light shielding portion) 55.

First of all, in the cam diagram shown in FIG. 10, the cam (in the condition before recording) is rotated to detect an edge 55*b* of the flag 55 when the light shielding condition is changed to the light passing condition, and then, the cam is further rotated therefrom by a predetermined angle and is temporarily stopped there. Thereafter, the cam is rotated again to detect an edge 55*a* of the flag 55 when the light passing condition is changed to the light shielding condition, and then, the cam is rotated therefrom by 38 degrees, thereby positioning the cam in a wiper-in position shown in FIGS. 3 and 9. The reason why the edge 55*a* is not detected at once in this continuous flow is that, if signal output as shown in FIG. 11 is generated by unstable motion of the cam during passage of the edge 55*b*, since the edge 55*b* which fundamentally indicates the condition when the light shielding is changed to the light passing may erroneously be detected as the edge 55*a* which indicates the condition when the light passing is changed to the light shielding at an error detection point, such error detection is prevented.

Such movement of the blade 14 as the wiper is obtained by driving the forward movement gear member 2B of the blade arm 20 by means of the forward movement gear member 30 of the drive gear 22 driven by the driving motor (not shown). As mentioned above, the drive gear 22 is constituted by integrally providing the forward movement gear member 30 and the rearward movement gear member 31 on the motor shaft 26, and, on the other hand, the forward movement gear member 28 and the rearward movement gear member 29 are integrally provided on the pivot shaft 23 of the blade arm 20. Thus, when the drive gear 22 is rotated from the condition of FIG. 3 in the direction A, since the forward movement gear member 30 is engaged by the gear member 28 to rotate the blade arm 20 in the direction B, the blade 14 is shifted to the left in FIG. 3 to establish the condition of FIG. 4, and thus, the wiping operation of the blade 14 for the discharge port face 13 of the recording head 3 is started. Further, it is assumed that a moving speed of the blade 14 during the wiping operation is P.

Then, when the drive gear 22 is further rotated in the direction A, the blade 14 as the wiper is passed by the discharge port face 13 while wiping the entire surface of the discharge port face and then abuts against a cleaning portion 45 of the cleaner 17 for effecting the cleaning of the blade 14. In this case, since the blade cleaner 17 is not rotated by the abutment between the abut portion 37 and the stopper 35, as shown in FIG. 5, the blade 14 is slidingly passed through the cleaning portion 45 while being flexed. In this case, the ink adhered to the tip ends of the blade 14 is wiped by the cleaner 17, thereby cleaning the blade. In this case, since only the tip ends of the blade 14 are cleaned, although a substantial amount of ink is still adhered to the entire blade 14, it is adequate that only the tip ends of the blade 14 are cleaned, and, accordingly, functionally, only the above-mentioned wiper cleaning is adequate.

When the blade 14 is passed under the cleaner 17, since the flexed blade 14 is released to be returned to an original condition (restored), as shown in FIG. 6, the residual ink adhered to the blade 14 is scattered to the left. In order to prevent contamination of the interior of the recording apparatus due to such scattering of ink, it is preferable that the wall 42 for receiving the scattered ink is provided at a left location in the vicinity of the blade cleaner 17 as near as possible. Further, it is very effective to extend the hood-shaped screen 43 from the blade cleaner 17.

Further, when the drive gear 22 is rotated in the direction A, as shown in FIG. 7, the forward movement gear member 30 of the drive gear 22 is disengaged from the forward movement gear member 28 of the blade arm 20, and the rearward movement gear member 31 of the drive gear 22 is engaged by the rearward movement gear member 29 of the blade arm 20 via the idle gear 32, thereby transmitting the driving force. Accordingly, the blade arm 20 starts to be rotated in the reverse direction D. Thus, the blade holder 15 and the blade 14 also start to be shifted in the reverse direction E (FIG. 7). In this case, when the wiper (blade) 14 is passed under the wiper cleaner (blade cleaner) 17, the wiper cleaner 17 is rotated in the direction C (FIG. 7), with the result that the cleaner is escaped and retarded by an amount corresponding to the overlap amount between the wiper 14 and the wiper cleaner 17.

Namely, the blade (wiper) 14 advances while pushing the blade cleaner 17 aside. Accordingly, the scattering of the ink is greatly decreased. Incidentally, the reason why the scattering of the ink is not eliminated completely in this case is that the blade 14 is slightly flexed by a force of the spring 40 biasing the blade cleaner 17. Here, it is assumed that a moving speed of the blade 14 is Q during a period from when the blade 14 is returned to the reverse direction at a point where the blade abuts against the cleaning portion 45 ash shown in FIG. 5 to when the blade is passed through the blade cleaner 17 while pushing it aside. When the drive gear 22 continues to be rotated in the direction as it is, the blade 14 is returned up to the condition of FIG. 3, thereby finishing one wiping operation (one wipe-cleaning). In this case, although the forward movement gear member 30 of the drive gear 22 is disengaged from the forward movement gear member 28 of the blade arm 20 to be in a free rotating condition, since an arm portion 20*a* of the blade arm 20 having elasticity is positioned in a valley of a cam 18*a* of the base 18, the blade arm 20 does not move from the position of FIG. 3 inadvertently.

As such, since the reciprocal movement of the wiper (blade) 14 can be performed only by one directional rotation of the driving motor (not shown), the wiping operation for the discharge port face 13 of the recording head 3 and the cleaning of the blade 14 itself (blade cleaning operation) can easily be executed properly in a single process. However, the driving of the blade 14 as mentioned above may be effected by the normal and reverse rotations of the driving motor or may be effected by using an actuator of translation type such as a solenoid. Here, the pre-defined wiping speed P is set to a relatively slow speed with attaching importance to the wiping ability for the discharge port face 13. Further, although it is not desirable that the pre-defined blade cleaning speed Q is set to be too high in consideration of the prevention of the ink scattering, it may be set to be slightly higher than the wiping speed P. Further, it is assumed that a speed other than these speeds P, Q is R, and it is desirable that the speed R is set to be as high as possible in order to hasten the series of recovering operations. Accordingly, a relationship between the speeds becomes $P < Q < R$.

Figure 12:
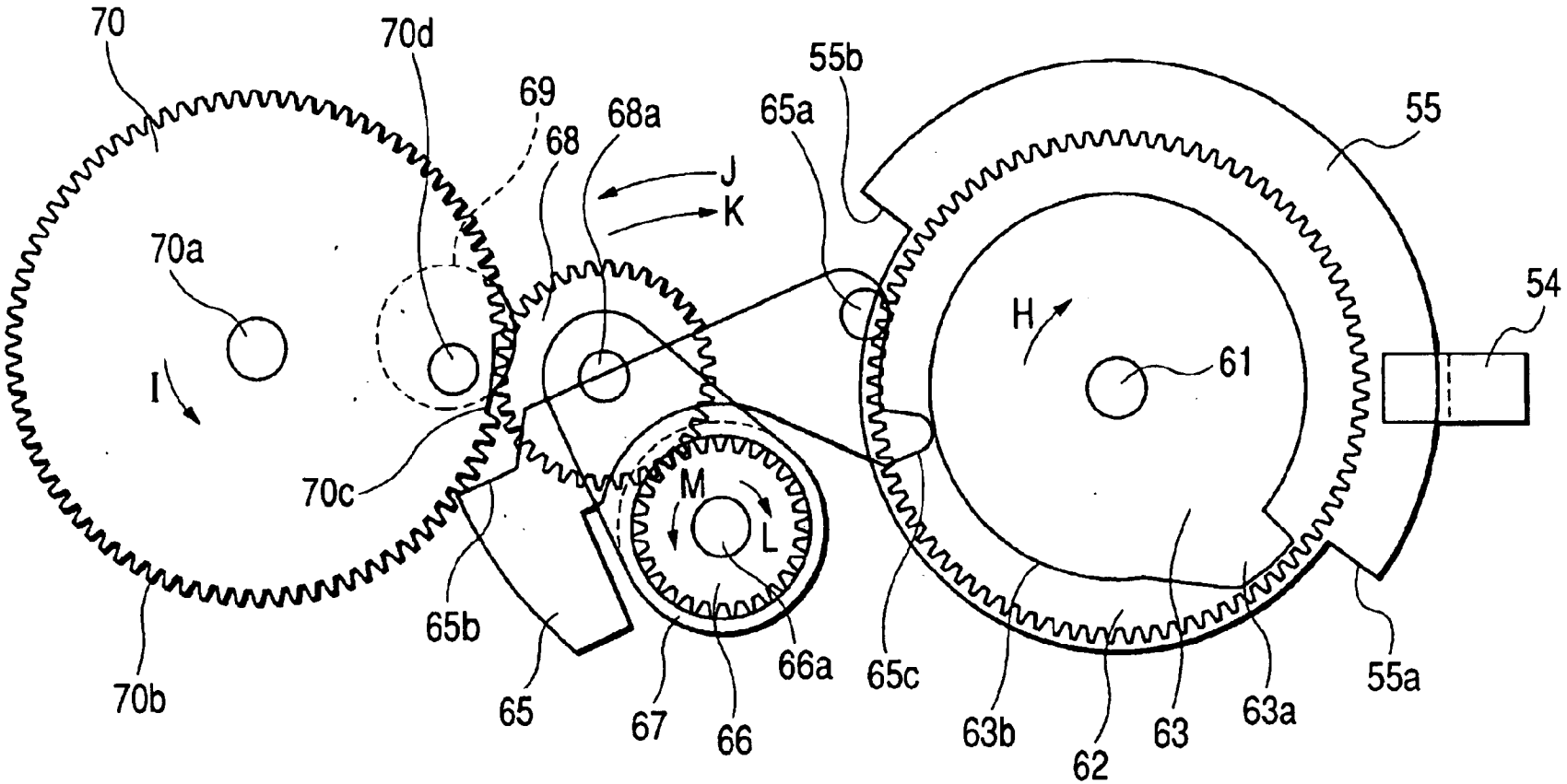
FIG. 12 is a side view showing a condition when a pump lever is in an inoperative position, in a driving mechanism of suction means (recovery means) of the recovery system according to the embodiment of the present invention to which the present invention is applied.
Figure 13:
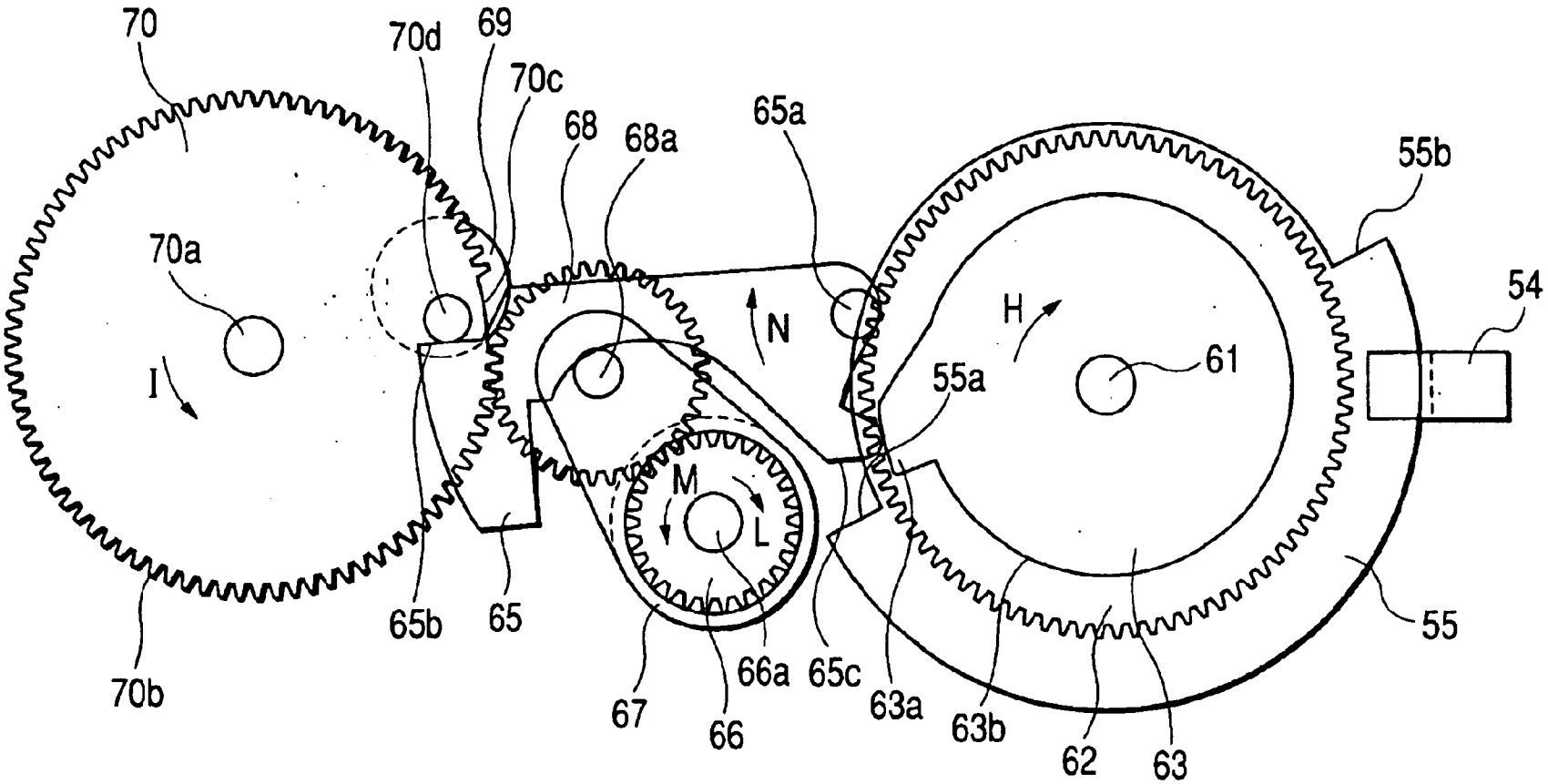
FIG. 13 is a side view showing a condition when the pump lever is in an operating position, in the driving mechanism of the suction means of FIG. 12.
Figure 14:
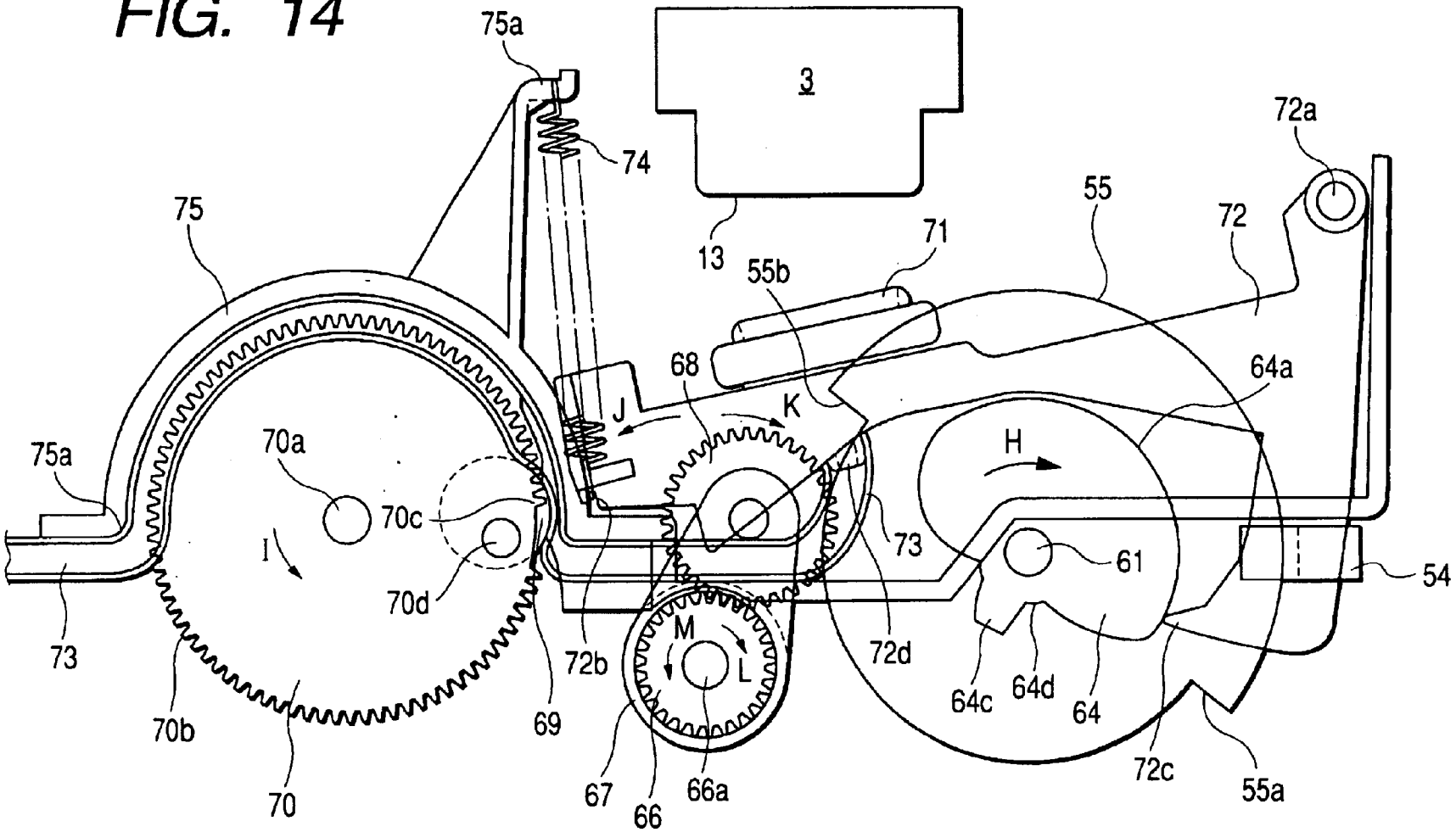
FIG. 14 is a side view showing a condition when various parts are in a waiting position, in the driving mechanism of the suction means of FIG. 12.
Figure 15:
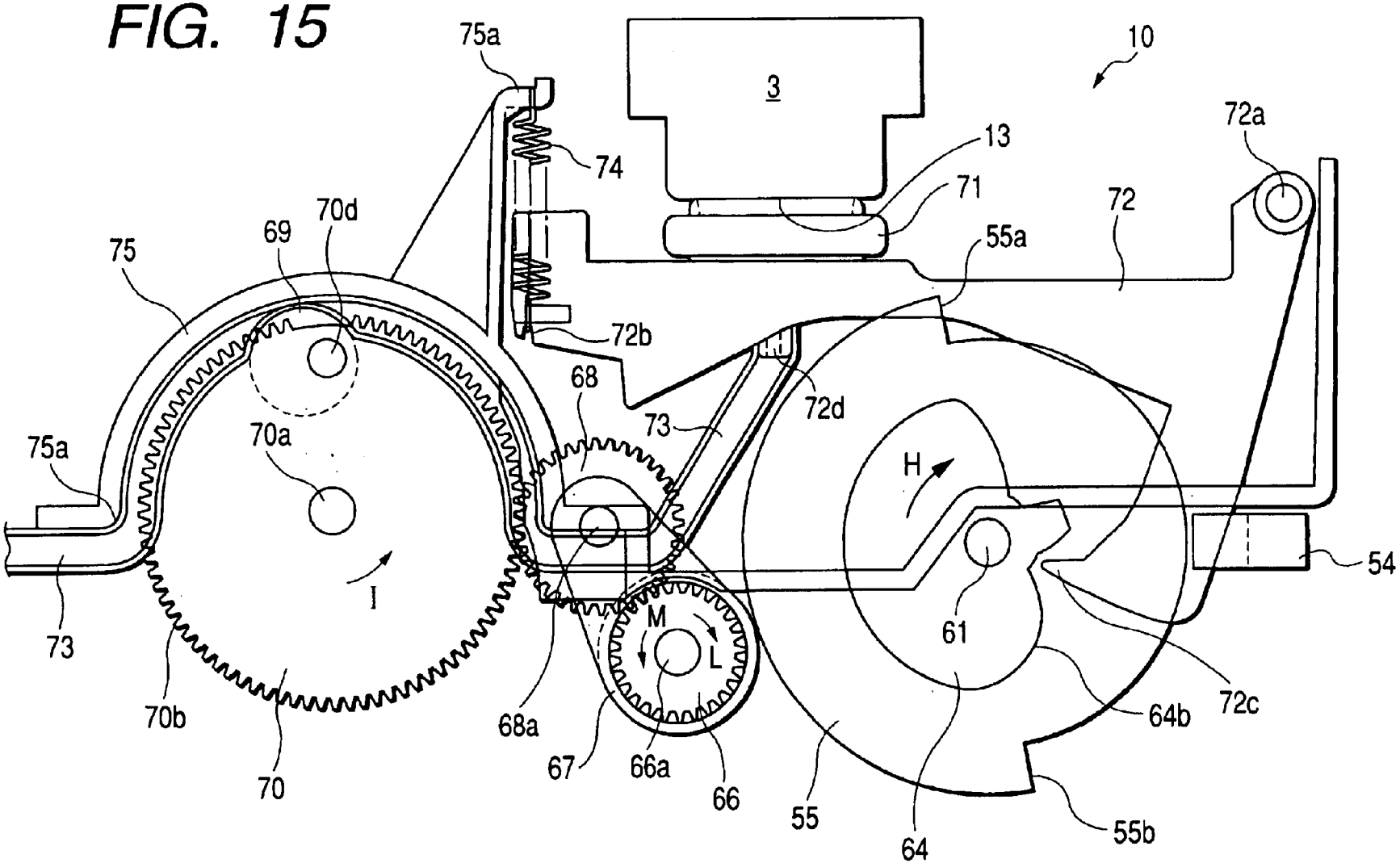
FIG. 15 is a side view showing a condition when various parts are in a suction operating position, in the driving mechanism of the suction means of FIG. 12.
Figure 16:
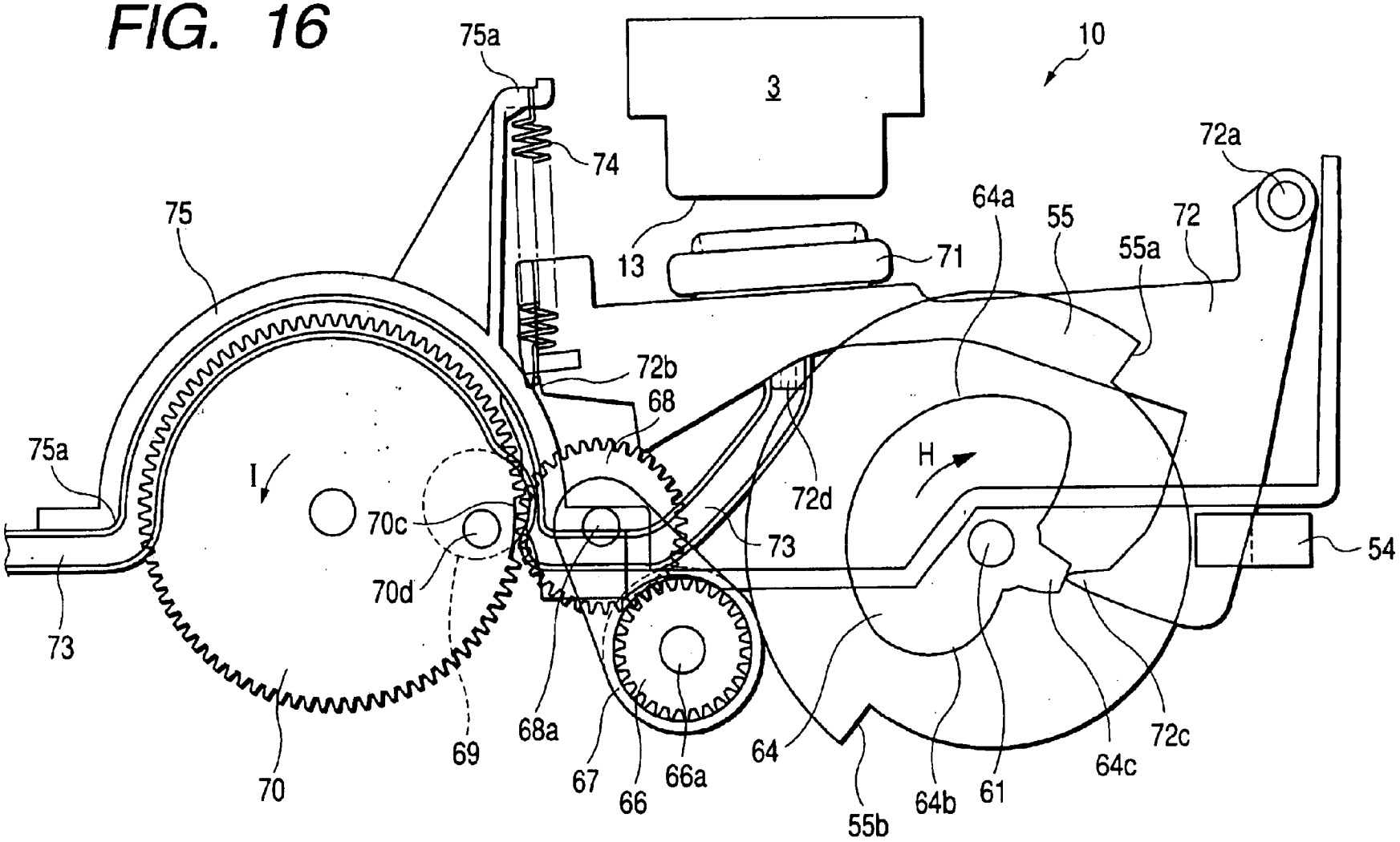
FIG. 16 is a side view showing a condition when a cam for discharging ink from interior of a cap for various parts, in the driving mechanism of the suction means of FIG. 12.
Figure 17:
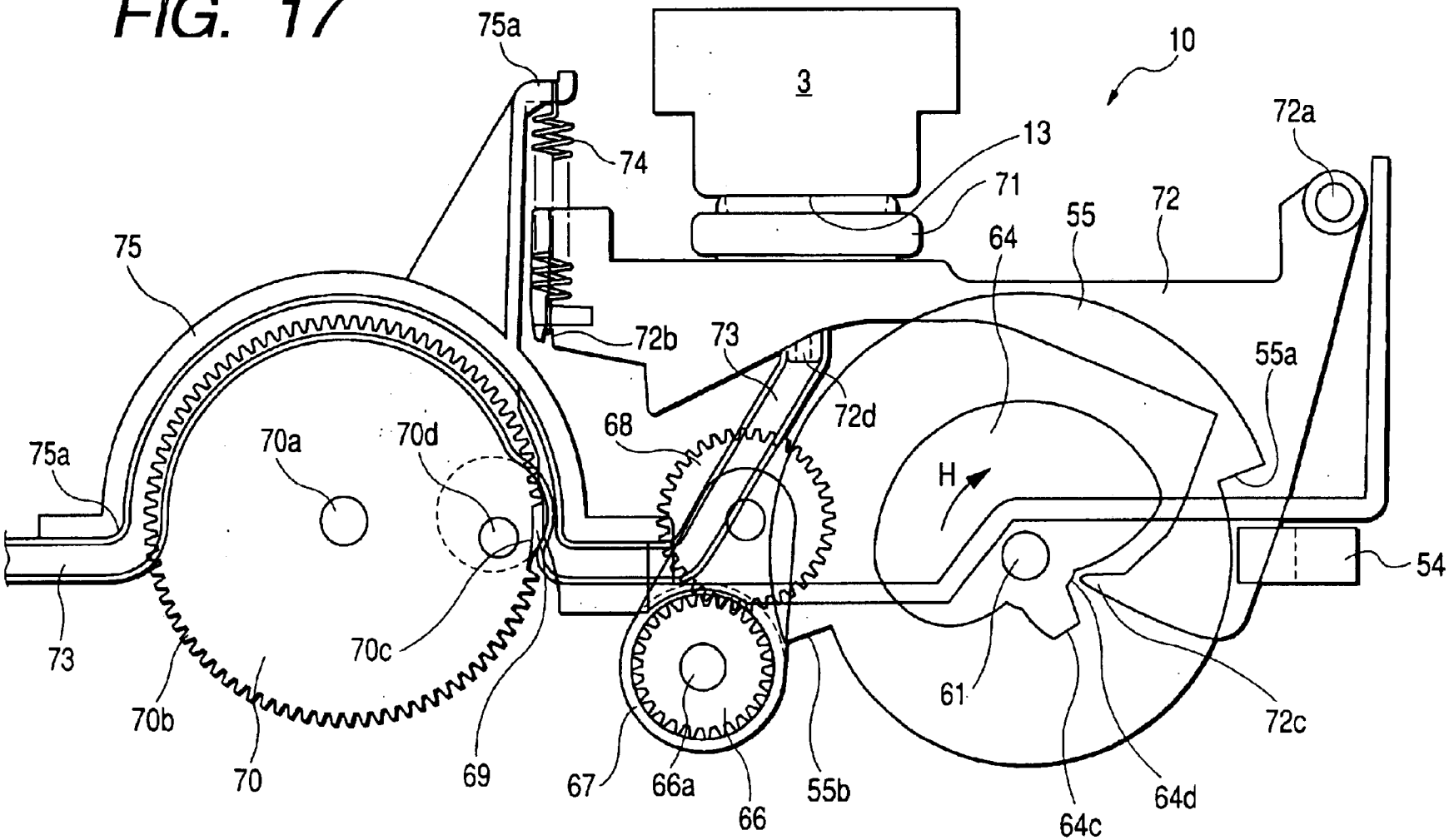
FIG. 17 is a side view showing a condition when various parts are in a single suction and cap re-contact position, in the driving mechanism of the suction means of FIG. 12.

FIG. 12 is a side view showing an inoperative condition of a pump lever in a driving mechanism of suction means (recovery means) of a recovery system 10 of an ink jet recording apparatus to which the present invention is applied, FIG. 13 is a side view showing an operating condition of the pump lever in the driving mechanism of the suction means of FIG. 12, FIG. 14 is a side view showing a waiting condition (cam P2 condition in FIG. 10) of various parts in the driving mechanism of the suction means of FIG. 12, FIG. 15 is a side view showing a suction condition (cam P6 condition in FIG. 10) of various parts in the driving mechanism of the suction means of FIG. 12, FIG. 16 is a side view showing a cam temporary stop condition (cam P8 condition in FIG. 10) of various parts for discharging the ink in the cap in the driving mechanism of the suction means of FIG. 12, and FIG. 17 is a side view showing a single suction and cap re-contact condition (cam P9 condition in FIG. 10) of various parts in the driving mechanism of the suction means of FIG. 12.

The recovery system 10 according to the illustrated embodiment is designed so that capping means for driving the suction means for suction recovery by one directional driving of the motor as the drive source of the recovery system 10 and for engaging and disengaging the cap with respect to the discharge port faces 13 of the recording heads 2, or both the capping means and the wiping means for wiping the discharge port faces 13 are driven by a cam having a coaxial position detecting flag portion and cam phase detection means. The recovery system 10 of the ink jet recording apparatus according to such an embodiment includes the following, characteristic construction and operation (particularly, construction and operation of suction means of the recovery system 10), in addition to the above-mentioned ones.

Now, the suction means (construction and operation thereof) of the recovery system 10 of the ink jet recording apparatus to which the present invention is applied will be explained with reference to FIGS. 12 to 17 and FIG. 10. Incidentally, parts or elements same as those used in the explanation of the construction and operation of the wiping means for wiping the discharge port faces 13 are designated by the same reference numerals. In FIGS. 12 and 14, a cam shaft 61 is coaxial with the motor shaft 26 in FIGS. 3 to 7, and the cam shaft 61 is coaxial with the gear members 30, 31 (explained in connection with the wiping means in FIGS. 3 to 7) and the flag 55, and a cam gear 62 and a lever cam 63 are arranged on the cam shaft, and an optical sensor 54 is positioned at a location which can be light-shielded by the flag 55.

Further, a pump lever 65 has a shaft 65*a* rotatably supported by a base 75 (FIG. 14), a cam abutment portion 65*c* capable of abutting against the lever cam 63, and a holder abutment portion 65*b* capable of abutting against a holder projection 70*d*. A sub-roller 69 is supported by a holder 70 for a sliding movement in a radial direction of the holder 70. The holder 70 has a shaft portion 70*a* rotatably supported by the base 75, an integral gear 70*b* having a non-toothed portion 70*c*, and a projection 70*d* located in the vicinity of the non-toothed portion 70*c* and capable of abutting against the pump lever 65. Further, a pendulum arm 67 is fitted onto an outer periphery of a center gear 66 having a shaft portion 66*a* rotatably supported by the base 75, and a pendulum gear 68 having a shaft portion 68*a* supported by the pendulum arm 67 can selectively be engaged by the cam gear 62 or the gear 70*b* of the holder 70.

The pendulum arm 67 is frictionally contacted with the center gear 66 by an appropriate mechanism (not shown) so that the pendulum arm can be rocked in a direction J or direction K in accordance with a rotational direction of the center gear 66. An arm 72 has a shaft portion 72*a* rockably supported by the base 75. A cap 71 attached to the arm 72 can abut against the discharge port faces 13 of the recording heads 3, and a pressurizing spring 74 is disposed between a spring hook portion 72*b* at a tip end of the arm 72 and a spring hook portion 75*a* of the base 75. Further, a cam engagement portion 72*c* of the arm 72 is urged against an arm cam 64 by the pressurizing spring 74. A tube 73 has one end connected to a pipe portion 72*d* of the arm 72 and is laid along the base 75 and can be squeezed by the sub-roller 69 pressurized by a spring (not shown). The other end of the tube 73 is connected to a waste ink reservoir (not shown).

Next, a suction recovery operation of the suction means (recovery means) of the recovery system 10 explained in connection with FIGS. 12 and 14 will be described. First of all, in FIGS. 12 and 14, when the center gear 66 is rotated in a direction shown by the arrow L by a driving force from a stepping motor (not shown), the pendulum arm 67 is driven by the rotation of the center gear 66 via the friction mechanism to be rocked in the direction K. In this case, the pendulum gear 68 is driven by the driving force from the center gear 66. When the center gear 66 is further rotated in the direction L, the pendulum gear 68 is engaged by the cam gear 62, with the result that the entire cam is rotated in a direction shown by the arrow H. In this case, the friction mechanism of the pendulum arm 67 is slipped with respect to the center gear 66.

Here, the entire cam is rotated in the direction H around the cam shaft 61, and an edge 55*a* of the flag 55 when the light passing condition is changed to the light shielding condition (P1 position in the cam diagram of FIG. 10) is detected by the sensor 54, and, from this point, the entire cam is rotated by 38 degrees (P2 position in the cam diagram of FIG. 10), thereby establishing the condition shown in FIGS. 12 and 14. Thereafter, the rotational direction of the stepping motor is reversed to rotate the center gear 66 in a direction shown by the arrow M. As a result, the pendulum arm 67 starts to be rocked in the direction J, with the result that the pendulum gear 68 is disengaged from the cam gear 62 and is engaged by the gear portion 70*b* of the holder 70, thereby rotating the holder 70 in a direction shown by the arrow I. When the holder 70 is further rotated in the direction I to establish the condition shown in FIGS. 12 and 14, due to the presence of the non-toothed portion 70*c* of the holder 70, the driving force of the pendulum gear 68 is not transmitted, with the result that the holder 70 is positioned at the position shown in FIGS. 12 and 14.

Then, by rotating the center gear 66 in the direction L again by rotating the motor reversely, an edge 55*b* of the flag 55 when the light shielding condition is changed to the light passing condition (P4 position in the cam diagram of FIG. 10) is detected by the sensor 54, and, from this point, the entire cam is rotated by 2 degrees, thereby establishing a P5 position in the cam diagram of FIG. 10. In this case, the entire cam is passed through a condition of FIG. 13 (Q condition in FIG. 10). That is to say, the pump lever 65 is rotated in a direction shown by the arrow N in FIG. 13 by a raised portion 63*a* of the lever cam 63, with the result that the projection 70*d* of the holder 70 is slightly rotated by the holder abutment portion 65*b* of the pump lever 65. As a result of such slight rotation as shown in FIG. 13, when the pendulum gear 68 enters into the engagement condition, since the pendulum gear is received by the gear portion 70*b* of the holder 70 rather than the non-toothed portion 70*c* of the holder 70, the holder 70 can be rotated in the direction I by the rotating force of the center gear 66.

Then, the recording heads 3 to be sucked are positioned at a position where the cap 71 can abut against the heads, i.e., position in a front-and-rear direction of the plane of FIG. 14 (position in the main scanning direction, i.e., position in the moving direction of the carriage 2). Then, the motor is rotated again to rotate the entire cam around the cam shaft 61 by 78 degrees, thereby establishing the condition of FIG. 15 (P6 condition in the cam diagram of FIG. 10). Here, the cap 71 is closely contacted with the discharge port faces 13 of the recording heads 3 by the force of the pressurizing spring 74. Thereafter, the motor is rotated reversely to rotate the center gear 66 in a direction shown by the arrow M in FIG. 15, thereby rotating the holder 70 from the position of FIG. 13 to the position of FIG. 15. Here, the sub-roller 69 rolls while squeezing the tube 73 by the pressurizing force of the pressurizing spring (not shown). As a result, negative pressure is generated in the cap 71 through the tube 73, thereby sucking the ink from the discharge ports of the recording heads 3.

When the condition of FIG. 15 is maintained for a predetermined time period, the pressure within the recording heads (recording means) 3 is substantially equilibrated with pressure (tube interior pressure) in an area at a right side of a portion of the tube 73 squeezed by the sub-roller 69, with the result that flow of ink is stopped. By the series of operations, a predetermined suction amount is obtained. Then, by slightly rotating the holder 70 in the direction I within the area where the tube 73 is squeezed by the sub-roller 69, slight negative pressure is generated, and the motor is rotated reversely at a timing before the pressure is equilibrated, and, at the same time, the entire cam is rotated in the direction H around the cam shaft 61, thereby establishing the condition of FIG. 16 (PB position in FIG. 10). By the rocking movement of the arm 72 in this process, since the cap 71 is spaced apart from the recording heads 3 in the condition that the slight negative pressure is applied to the interior of the cap 71, an amount of residual ink remaining on the cap abutment surfaces (discharge port faces 13) of the recording heads 3 can be minimized.

Then, the motor is rotated reversely again to rotate the holder 70 in the direction I, thereby establishing a condition that the holder 70 is disconnected from the driving of the pendulum gear 68 as shown in FIG. 16, i.e., a condition that the pendulum gear is opposed to the non-toothed portion 70*c*. In this process, since the tube 73 is being squeezed by the sub-roller 69 during a time period till when the sub-roller is passed through an R portion (round corner portion) 75*a* of the base 75 from the condition that the sub-roller is slightly rotated in the direction I in FIG. 15, almost all of the ink sucked in the cap 71 is discharged into the tube 73. Thereafter, the motor is rotated reversely again to rotate the entire cam in the direction H, thereby moving the cam from the condition of FIG. 16 to a condition of FIG. 17 (P9 position in FIG. 10), and the edge 55*a* of the flag 55 when the light passing condition is changed to the light shielding condition is detected by the sensor 54 (P1 position in FIG. 10), and, from this point, the entire cam is rotated by 38 degrees (P2 position in FIG. 10), thereby establishing the condition of FIGS. 12 and 14.

In this case, although the cap 71 abuts against the recording heads 3 again in the condition of FIG. 17, as mentioned above, since almost all of the ink in the cap 71 was discharged into the tube 73, the ink in the cap 71 can be prevented from being transferred onto the discharge port faces 13 of the recording heads 3 again. Then, the carriage 2 (FIG. 1) on which the recording heads 3 are mounted is shifted in the front-and-rear direction of the plane of FIG. 14 (main scanning direction, i.e., moving direction of the carriage 2), thereby retarding the recording heads 3 from an area above the cap 71. In this case, when the positioning is effected by rotating the entire cam in the direction H as the cap 71 is spaced apart, since the cam is rotated by the predetermined angle by detecting the edge 55*a* of the flag 55 when the light passing condition is changed to the light shielding condition, rotational angle error accumulated by repeated rocking movements of the pendulum arm 67 during the suction operation and slight over-run of the entire cam are all cancelled, thereby positioning the phase of the entire cam at the proper position positively with high accuracy.

In the above-mentioned embodiments, while an example that the plural recording heads 3 are sucked simultaneously was explained, when the single recording head is sucked solely, the procedure in which the cam is positioned in the P2 position in FIG. 10 and the sub-roller 69 and the non-toothed portion of the holder 70 are positioned is the same as mentioned above. Thereafter, the cam is positioned in the P7 position in FIG. 10 by detection of the edge 55*b* of the flag 55 when the light shielding condition is changed to the light passing condition, and the recording head 3 is positioned in the front-and-rear direction of the plane of FIG. 14 (main scanning direction, i.e., moving direction of the carriage 2), and the cam is rotated by 45.5 degrees to establish the P9 position in FIG. 10, and the capping operation is effected, and the holder 70 is rotated in the same procedure as mentioned above to achieve negative pressure application, fixed time maintaining (obtaining of predetermined suction amount) and slight negative pressure application due to slight rotation of the holder 70. Thereafter, the entire cam is rotated at a timing before the pressure is equilibrated, and the temporary stopping of the cam is omitted to detect, at once, the edge 55*a* of the flag 55 when the light passing condition is changed to the light shielding condition by the sensor 54 (P1 position in FIG. 10), and, from this point, the entire cam is rotated by 38 degrees (P2 position in FIG. 10), thereby establishing the condition of FIGS. 12 and 14.

In this way, when the phase of the entire cam is determined before the recording head 3 is positioned, by using the edges to be detected properly in such a manner that the edge 55*a* of the flag 55 when the light passing condition is changed to the light shielding condition is used in the case where the discharge port face 13 is wiped by the wiping means and the edge 55*b* of the flag 55 when the light shielding condition is changed to the light passing condition is used in the case where the ink is sucked from the discharge ports 82 by the suction means, the rotational amount of the entire cam can be reduced, thereby effecting the recovery mode efficiently.

Next, an operation of respective recovery means, i.e., an operation of the wiping means and an operation of the suction means of the recovery system 10 at initial usage (first usage) of the ink jet recording apparatus having the above-mentioned construction will be explained. Since the recording heads have already been mounted on the carriage 2 when the recording apparatus is forwarded from the manufacturing factory, the user firstly mounts the ink tanks 9 on the recording heads 3. Thereafter, since the recording apparatus recognizes or confirms initial usage (first usage) on the basis of a trigger such as information in an EEPROM, first (initial) recording command and the like, an on-arrival recovery mode is started.

First of all, the suction operation of the suction means is effected. In accordance with the aforementioned procedure of the suction operation, the carriage 2 is firstly positioned at the predetermined position, and then, the cap 71 is closely contacted with the discharge port faces 13 of the recording heads 3, and the holder 70 is rotated, and the sub-roller 69 is rolled while squeezing the tube 73. As a result, the tube 73 is squeezed within the predetermined range to generate the negative pressure within the cap 71 through the tube 73, thereby sucking and discharging the ink from the discharge ports 82. In this case, in order to exchange the transporting ink filled in the recording heads 3 to the recording ink positively, the suction pressure (degree of negative pressure) is set to be greater than that in a normal recovery mode by setting the rotational speed of the holder 70 to be greater than that in the normal suction recovery operation and the suction amount is set to be greater than the suction amount in the normal recovery mode by setting the rotational amount of the holder 70 to be greater than that in the normal recovery mode. Further, the exchange from the transporting ink to the recording ink within the recording means (recording heads) 3 may be effected further positively by repeating the suction operation (suction recovery operation) in the normal recovery mode by plural times.

Following the suction operation of the suction means, the wiping operation of the wiping means, i.e., wiping operation for wiping and cleaning the discharge port faces of the recording heads 3 by the wipers (blades) 14 is started. The carriage 2 is positioned at the predetermined position, and then, the cam is rotated to effect the wiping operation of the blades 14 against the discharge port faces 13 of the recording heads 3, and then, the carriage 2 is retracted from the wiping position and the blades 14 are returned to their initial positions. In order to positively remove the transporting ink adhered to the discharge port faces 13 of the recording heads 3 after suction, the wiping operation may be repeated by plural times.

Further, only the blades 14 are operated in a condition that the wipers (blades) 14 are not contacted with the discharge port faces 13 of the recording heads 3, without positioning the cap 71 at the wiping position, and the cleaning of the blades 14 themselves is effected when the blades 14 are passed through the cleaner 17 for cleaning the blades, and the cleaning operations for the blades themselves is effected much more than the normal wiping operations, thereby cleaning the blades to which the transporting ink is adhered more positively.

Further, in order to positively remove the transporting ink within the cap 71 after the suction operation, the carriage 2 may be retracted from the area above (immediately above) the recovery system 10, and idle suction operations for rotating the holder 70 without closely contacting the cap 71 with the discharge port faces 13 of the recording heads 3 may be performed by plural times. As a result, the transporting ink can positively be discharged from the cap 71. If the recording ink tanks were not previously mounted, since the exchange from the transporting ink to the recording ink may not be performed smoothly, the fact whether the ink tanks are mounted to mounting sections for mounting the ink tanks containing the recording ink to be supplied to the recording heads or not is detected by detection means (ink tank presence/absence detection means). If the fact that the ink tanks are not mounted is detected, it is preferable that, upon request of the on-arrival recovery mode, an alarm is emitted to the user of the apparatus by alarm means, thereby calling upon the user to perform the mounting of the ink tanks.

The transporting ink has already been filled in the ink jet recording apparatus having the recovery system (recovery device) 10 as mentioned above and the recording heads (ink jet heads) mounted to the ink jet recording apparatus when the recording apparatus is forwarded from the manufacturing factory, and viscosity of the transporting ink is preferably in a range between about 3 to 10.3 cp. Viscosity of the recording ink used in the normal recording is about 2 cp and moisture composition thereof is about 70%. Further, transporting inks conventionally proposed were almost not different from the recording ink regarding viscosity and moisture composition, except for removal of coloring material. To the contrary, the transporting ink used in the present invention is formed in such a manner that an amount ratio of solvents such as glycerol, urea, triethylene glycol and trimethanol propane is increased and moisture composition is reduced below 50%. In this way, change in composition due to time-lapse evaporation change is suppressed and storing stability of the recording heads is maintained. In the present invention, as the transporting ink, ink which does not include color material or has a color material component less than that of the recording ink is used.

Further, at the first usage of the ink jet recording apparatus 1, before or during the suction recovery operation of the recovery system (recovery mechanism) 10, or during a time period from before start of suction till end of suction, after the ink jet recording apparatus was transported, by applying a desired electrical signal to the ink temperature maintaining electrothermal converter (heat generating resistance body) 86 shown in FIG. 18 to drive the latter, the transporting ink in the common liquid chamber 83 is heated. Alternatively, by applying an electrical signal having a magnitude which does not discharge the ink to the ink discharging electrothermal converters (heat generating resistance bodies) 85 to drive the latter, the transporting ink in the recording heads may be heated. Further, alternatively, by driving both the ink temperature maintaining electrothermal converter 86 and the ink discharging electrothermal converters 85, the transporting ink may be heated.

Further, at the first usage of the ink jet recording apparatus 1, before or during the suction recovery operation of the recovery system (recovery mechanism) 10, or during a time period from before start of suction till end of suction, after the ink jet recording apparatus was transported, by driving the ink discharging electrothermal converters (heat generating resistance bodies) 85 shown in FIG. 18, the transporting ink is discharged, thereby aiding the discharging of the transporting ink. Alternatively, at the first usage, before or during the suction recovery operation of the recovery system (recovery mechanism) 10, or during a time period from before start of suction till end of suction, by driving the ink discharging electrothermal converters 85, the ink is discharged thereby to aid the discharging of the transporting ink, while maintaining the temperature of the transporting ink in the common liquid chamber 83 by driving the ink temperature maintaining electrothermal converter 86.

Figure 20:
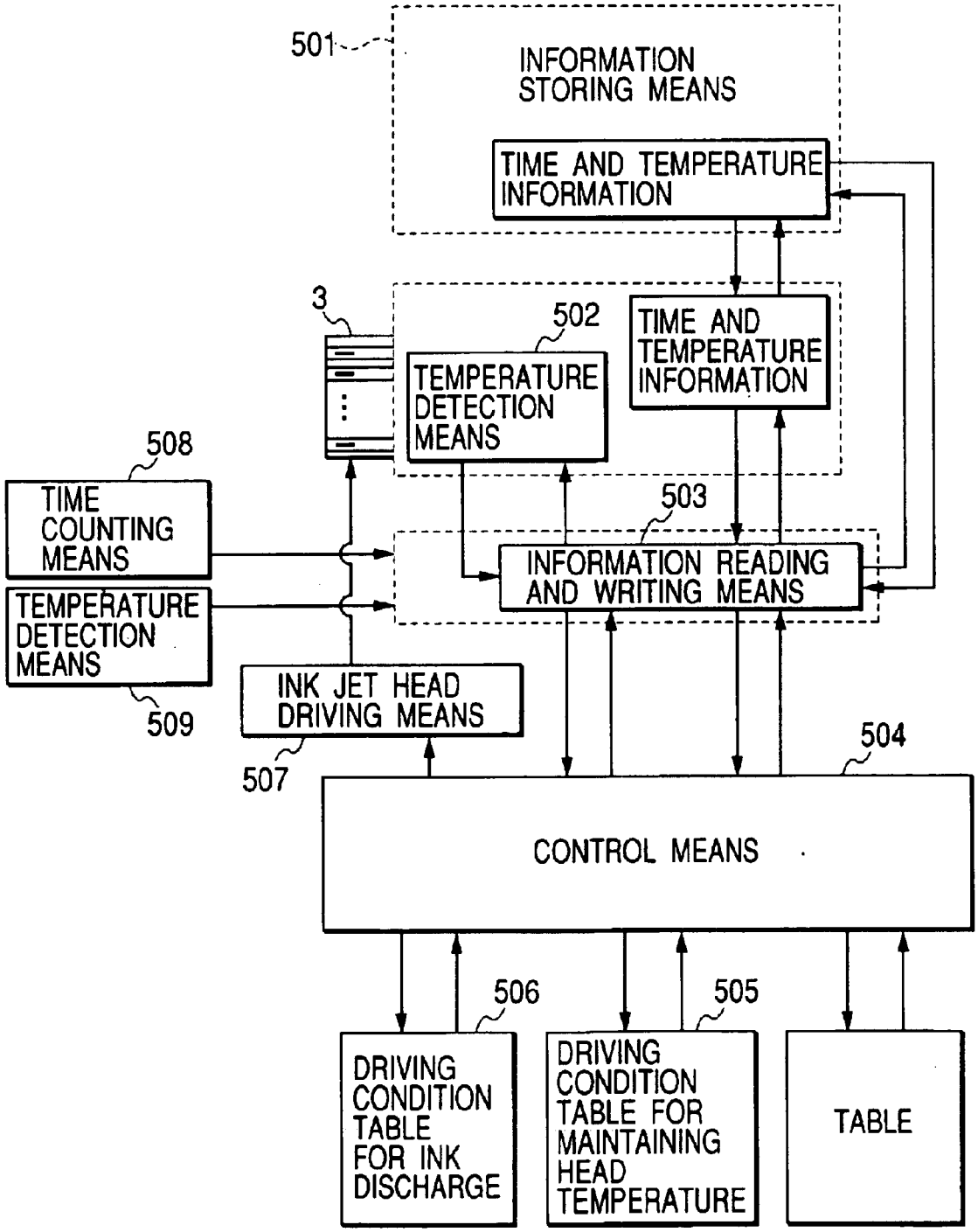
FIG. 20 is a block diagram showing a schematic construction of a control device for effecting control regarding a heating amount and a suction amount of the recording head on the basis of information regarding time and temperature in the ink jet recording apparatus to which the present invention is applied.

FIG. 20 is a block diagram showing a schematic construction of a control device for effecting control regarding a heating amount and a suction amount of the recording heads on the basis of information regarding time and temperature in the ink jet recording apparatus to which the present invention is applied. In the ink jet recording apparatus to which the present invention is applied, as shown in FIG. 1, the information storing means 101, 408 provided in the recording apparatus or the ink jet recording head 3 shown in FIG. 19 is constituted by EEPROMs or flash ROMS to provide information storing means capable of writing and updating, and, by using such information storing means, temperature information and time information from the temperature detection means 102 and the time counting means 103 provided in the ink jet recording apparatus 1 and from the temperature detection means 409 provided in the recording head 3 are stored. As shown in FIG. 20, from a time when the ink jet recording apparatus is forwarded from the factory, the temperature information and time information stored in the information storing means 51 of the recording apparatus 1 or the recording head 3 are updated by information reading and writing means 503 at any time interval, and the updated information is written in the information storing means 101, 408.

The stored information is read out by the stored information reading means 503 provided in the ink jet recording apparatus, and control as shown in FIG. 20 is performed at a time when the forwarding (transportation) of the recording apparatus is finished, i.e., before or during the suction recovery operation of the recovery system (recovery mechanism) 10 at the first usage. That is to say, elapsed time information and temperature information are read from the information storing means 101 of the ink jet recording apparatus or the information storing means 408 (not shown) of the ink jet recording head 3 by the information reading and writing means 503, and the read information is transferred to control means 504.

Thereafter, by using a predetermined driving condition table 506 for the ink discharging electrothermal converters (heat generating resistance bodies) 85 and a driving condition table 505 for the ink temperature maintaining electrothermal converter (heat generating resistance body) 86, optimum temperature condition and ink discharging condition given by the ink discharging electrothermal converters 85 and the ink temperature maintaining electrothermal converter 86 are determined. These driving conditions for the recording head 3 are transmitted to the recording head 3 via ink jet head driving means 507, thereby driving the recording head. In this case, control in consideration of environmental temperature is also possible by the temperature detection means 502 (FIG. 20) of the recording head 3 or the temperature detection means 102 of the ink jet recording apparatus, i.e., by temperature detection means 509 in FIG. 20 in the first recovery operation. Further, such control permits first recovery control by effecting information storing for each color or each discharge port array.

In the embodiment explained in connection with FIGS. 19 and 20, in the recovery operation during or before the ink suction from the recording head 3 by means of the recovery means in the on-arrival recovery mode executed by the recovery means in the first usage of the recording apparatus, since the transporting ink is heated to reduce viscosity thereof by the ink temperature maintaining electrothermal converter 86 and the ink discharging electrothermal converters 85 in the recording head 3 or preliminary discharge (ink is discharged from the discharge ports for the purpose other than the recording) effected by the ink discharging electrothermal converters 85 is combined with the suction operation, even when the transporting ink which generally has viscosity greater than that of the recording ink is used, such transporting ink can well be sucked and removed from the recording head 3, with the result that the transporting ink and the recording ink can be prevented from being mixed during the image formation, thereby preventing deteriorating of image quality due to the transporting ink.

As apparent from the above-mentioned explanation, according to the aforementioned embodiments, in the ink jet recording apparatus comprising the carriage 2 for mounting the recording head 3 for effecting recording by discharging the recording ink and for moving the recording head, and the recovery means for effecting the recovery operation such as the suction operation and/or the wiping operation with respect to the recording head, and wherein the recording apparatus is forwarded from the manufacturing factory in a condition that the recording head filled with the transporting ink different from the recording ink is mounted on the carriage, since the on-arrival recovery mode executed by the recovery means upon first usage of the recording apparatus by the user differs from the normal recovery mode executed by the recovery means after the first usage, even when the transporting ink having the special composition is filled in the recording head in order to maintain the recording quality of the recording head during the transportation from the manufacturing factory from which the recording apparatus is forwarded to the user and during the storage of the recording apparatus, the exchange from the transporting ink to the recording ink can be effected positively when the user initially uses the recording apparatus, and removal of the residual transporting ink within the recovery means can be promoted, and the residual transporting ink can be prevented from being transferred onto the recording head 3 again, with the result that the time for setting the recording head 3 at the start of usage of the recording apparatus can be saved, and inconvenience due to erroneous setting of the recording head 3 can be avoided, and setting-up ability of the recording apparatus can be enhanced, and poor recording quality due to the transporting ink at the initial stage of usage of the recording apparatus can be eliminated.

Further, according to the aforementioned embodiments, the suction means for effecting suction from the recording head is provided as the recovery means, and, by setting suction pressure of the suction means upon ink suction from the recording head 3 in the on-arrival recovery mode to be higher than suction pressure upon ink suction in the normal recovery mode, even when the transporting ink which may have viscosity greater than that of the recording ink is used, the transporting ink can well be sucked and removed from the recording head 3, and the exchange from the transporting ink to the recording ink within the recording head 3 can be effected positively, and inconvenience regarding deterioration of image quality due to mixing of the transporting ink with the recording ink in the recording head 3 during the image formation can be prevented.

Further, according to the aforementioned embodiments, the suction means for effecting suction from the recording head 3 is provided as the recovery means, and, by setting a suction amount of the suction means upon ink suction from the recording head 3 in the on-arrival recovery mode to be greater than a suction amount upon ink suction in the normal recovery mode, even when the transporting ink which may have viscosity greater than that of the recording ink is used, the transporting ink can well be sucked and removed from the recording head 3, and the exchange from the transporting ink to the recording ink within the recording head 3 can be effected positively, and inconvenience regarding deterioration of image quality due to mixing of the transporting ink with the recording ink in the recording head 3 during the image formation can similarly be prevented.

Further, according to the aforementioned embodiments, the suction means for effecting suction from the recording head 3 is provided as the recovery means, and, by setting the number of suction operations of the suction means upon ink suction from the recording head 3 in the on-arrival recovery mode to be greater than the number of suction operations upon ink suction in the normal recovery mode, even when the transporting ink which may have viscosity greater than that of the recording ink is used, the transporting ink can well be sucked and removed from the recording head 3, and the exchange from the transporting ink to the recording ink within the recording head 3 can be effected positively, and inconvenience regarding deterioration of image quality due to mixing of the transporting ink with the recording ink in the recording head 3 during the image formation can similarly be prevented.

Furthermore, according to the aforementioned embodiments, by providing the on-arrival recovery mode as a mode wherein suction operations of one kind in the normal recovery mode are repeated continuously plural times, even when the transporting ink which may have viscosity greater than that of the recording ink is used, the transporting ink can well be sucked and removed from the recording head 3, and the exchange from the transporting ink to the recording ink within the recording head 3 can be effected positively, and inconvenience regarding deterioration of image quality due to mixing of the transporting ink with the recording ink in the recording head 3 during the image formation can similarly be prevented.

Furthermore, according to the aforementioned embodiments, the suction means for effecting suction from the recording head 3 is provided as the recovery means, and, by setting the number of idle suction operations for discharging the ink from a cap 71 by driving the suction means in a communication condition between the interior of the cap and the atmosphere upon ink suction from the recording head 3 by the suction means in the on-arrival recovery mode to be greater than the number of idle suction operations in the normal recovery mode, the transporting ink remaining within the cap 71 can be discharged positively, and the interior of the cap can also be filled with the recording ink, with the result that the residual transporting ink within the cap can be prevented from being transferred into the recording head again during the further capping and/or suction operations, and inconvenience regarding deterioration of image quality due to mixing of the transporting ink with the recording ink in the recording head 3 during the recording can be prevented more efficiently.

Further, according to the aforementioned embodiments, the suction means for effecting suction from the recording head 3 and wipers 14 for wiping the recording head 3 are provided as the recovery means, and, by setting the number of wiping operations of the wipers 14 after ink suction from the recording head 3 by the suction means in the on-arrival recovery mode to be greater than the number of wiping operations after ink suction in the normal recovery mode, the transporting ink remaining on the discharge port face 13 of he recording head 3 can be removed positively by the wiping operations, and inconvenience regarding deterioration of image quality due to mixing of the transporting ink with the recording ink in the recording head 3 during the recording can be prevented more efficiently.

Further, according to the aforementioned embodiments, the wipers. 14 for wiping he recording head 3 and the cleaner 17 for cleaning the wipers are provided as the recovery means, and, by setting the number of cleaning operations of the cleaner 17 after the wiping of the wipers 14 in the on-arrival recovery mode to be greater than the number of cleaning operations after the wiping in the normal recovery mode, when the discharge port face 13 of the recording head 3 is wiped, the residual transporting ink adhered to the wipers 14 can be removed positively, and the residual transporting ink can be prevented from being transferred to the discharge port face 13 of the recording head 3 during further wiping, and inconvenience regarding deterioration of image quality due to mixing of the transporting ink with the recording ink in the recording head 3 during the recording can be prevented more efficiently.

Further, according to the aforementioned embodiments, the suction means for effecting suction from the recording head 3 and wipers 14 for wiping the recording head 3 are provided as the recovery means and, in the on-arrival recovery mode, after ink suction from the recording head 3 is firstly effected by the suction means, by effecting the wiping of the wipers 14, since the process for exchanging from the transporting ink to the recording ink in the recording head 3 is finished before the transporting ink is adhered to new wipers 14 and since the wiping operation is effected in a condition that the transporting ink is substantially removed from the discharge port face 13 of the recording head 3 and from the recording head, adhesion of the transporting ink onto the new wipers 14 and the transferring of the residual transporting ink onto the discharge port face 13 during the further wiping can be prevented, and good image quality can be maintained continuously from the initiation of usage of the recording apparatus.

Furthermore, in the aforementioned embodiments, by adopting the arrangement in which the viscosity of the transporting ink is greater than that of the recording ink or an arrangement in which the recording ink includes color material and the transporting ink does not include color material or has less color component than that of the recording ink, even when composition of the transporting ink is specialized in order to maintain the recording quality of the recording head 3 during the transportation from the manufacturing factory from which the ink jet recording apparatus is forwarded to the user or during storage of the recording apparatus, the exchange from the transporting ink to the recording ink at the first usage of the recording apparatus by the user can be effected positively, removal of the residual transporting ink within the recovery means can be promoted, and re-transferring of the residual transporting ink onto the recording head 3 can be prevented. As a result, the time for setting the recording head 3 at the start of usage of the recording apparatus can be saved, and inconvenience due to erroneous setting can be avoided, and setting-up ability of the recording apparatus can be enhanced, and poor recording quality due to the transporting ink at the initial stage of usage of the recording apparatus can be eliminated, thereby obtaining a good image.

Furthermore, in the aforementioned embodiments, in the ink jet recording apparatus comprising the carriage 2 for mounting the recording head 3 for effecting recording by discharging the recording ink and for moving the recording head, and the recovery means for effecting the recovery operation with respect to the recording head, and wherein the recording apparatus is forwarded from the manufacturing factory in a condition that the recording head filled with the transporting ink different from the recording ink is mounted on the carriage, since the on-arrival recovery mode executed by the recovery means upon first usage of the recording apparatus by the user is the same as a recovery mode executed upon exchange of the recording head 3 among a plurality of recovery modes executed by the recovery means after the first usage, even if the recording head 3 is exchanged for any reason when the user initially uses the recording apparatus, the exchange from the transporting ink to the recording ink can be effected positively at the first usage of the recording apparatus without increasing the recovery modes, and removal of the residual transporting ink in the recovery system 10 can be promoted, and re-transferring of the residual transporting ink onto the recording head 3 can be prevented, thereby simplifying the operation sequence of the recording apparatus.

Furthermore, according to the aforementioned embodiments, in the ink jet recording apparatus comprising the carriage 2 for mounting the recording head 3 for effecting recording by discharging the recording ink and for moving the recording head, and the mounting section for mounting the ink tank for storing the recording ink to be supplied to the recording head 3, and wherein the recording apparatus is forwarded from the manufacturing factory in a condition that the recording head filled with the transporting ink different from the recording ink is mounted on the carriage, by adopting an arrangement including detection is means for detecting whether the ink tank is mounted on the mounting section, and alarm means for emitting alarm to the user of the recording apparatus if the fact that the ink tank is not mounted on the mounting section upon first usage of the recording apparatus by the user is detected by means of the detection means, the recording ink tank can positively be set in the on-arrival recovery mode, and the exchange operation from the transporting ink to the recording ink in the recording head can be effected more positively, and good image quality can be maintained continuously from the initiation of usage of the recording apparatus.

Further, in the aforementioned embodiments, by designing the recording head 3 to have the electrothermal converters 85 for generating thermal energy used for discharging the ink or by designing the recording head 3 so that the ink is discharged by utilizing the pressure change based on growth of the, bubble created by the film boiling generated by the thermal energy from the electrothermal converter 85, the above-mentioned effects can be achieved efficiently.

Further, in the aforementioned embodiments, by adopting an arrangement in which the transporting ink is heated by the ink temperature maintaining electrothermal converter 86 within the recording head before or during the ink suction by the suction means in the on-arrival recovery mode, or an arrangement in which the transporting ink is heated by the ink discharging electrothermal converter 85 within the recording head, or an arrangement in which the transporting ink is heated by the ink temperature maintaining electrothermal converter 86 and the ink discharging electrothermal converter 85 within the recording head, or an arrangement in which the transporting ink is discharged by the ink discharging electrothermal converter within the recording head, or an arrangement in which the transporting ink is heated by the ink temperature maintaining electrothermal converter 86 within the recording head and the transporting ink is discharged by the ink discharging electrothermal converter 85, even when the transporting ink has viscosity greater than that of the recording ink, by reducing the viscosity of the transporting ink, the transporting ink can well be sucked and removed from the recording head, and the exchange from the transporting ink to the recording ink within the recording head can be effected more positively.

Further, in the aforementioned embodiments, by adopting an arrangement in which the transporting ink is heated by the ink temperature maintaining electrothermal converter 86 within the recording head during the time period from before the ink suction of the suction means to the end of the suction in the on-arrival recovery mode, or an arrangement in which the transporting ink is heated by the ink discharging electrothermal converter 85 within the recording head, or an arrangement in which the transporting ink is heated by the ink temperature maintaining electrothermal converter 86 and the ink discharging electrothermal converter 85 within the recording head, or an arrangement in which the transporting ink is discharged by the ink discharging electrothermal converter 85 within the recording head, or an arrangement in which the transporting ink is heated by the ink temperature maintaining electrothermal converter 86 within the recording head and the transporting ink is discharged by the ink discharging electrothermal converter 85, even when the transporting ink has viscosity greater than that of the recording ink, by reducing the viscosity of the transporting ink, the transporting ink can well be sucked and removed from the recording head, and the exchange from the transporting ink to the recording ink within the recording head can be effected more positively.

Further, in the aforementioned embodiments, by adopting an arrangement in which, when the transporting ink is heated and discharged by an ink discharging electrothermal converter within the recording head from before the ink suction to the end of the ink suction by the suction means in the on-arrival recovery mode, an input signal value, frequency, ink color to be inputted and a discharge port can be selected appropriately and, by adopting an arrangement in which any input signal value, frequency and ink color can be inputted to the ink temperature maintaining electrothermal converter 86 of the recording head 3, the exchange from the transporting ink to the recording ink within the recording head can be effected more positively.

Further, in the aforementioned embodiments, by adopting an arrangement including the time counting means 103 for counting the elapsed time from the forwarding, or an arrangement including the time reading means for reading the elapsed time from the forwarding, or an arrangement including the control means for judging and determining the heating amount of the recording head 3 on the basis of the elapsed time from the forwarding, or an arrangement including the temperature history storing means for storing temperature history from the forwarding, or an arrangement including the temperature history reading means for reading the temperature history from the forwarding, or an arrangement including the heating control means for judging and determining the heating amount of the recording head 3 on the basis of the temperature history from the forwarding, or an arrangement in which a heating temperature for each color can be set by the heating control means, by optimizing the heating value and the suction condition, the exchange from the transporting ink to the recording ink within the recording head can be effected more positively.

Further, in the aforementioned embodiments, by adopting an arrangement including the storing means capable of re-writing and calling the elapsed time and the temperature history from the forwarding, correct information can always be maintained, and, by optimizing the ink discharging condition, heating amount and suction condition, the exchange from the transporting ink to the recording ink within the recording head can be effected more positively. Further, in the aforementioned embodiment, by adopting an arrangement in which the viscosity of the transporting ink is greater than that of the recording ink, storing stability of the recording head can be enhanced.

Further, according to the above-mentioned embodiments, in the method for handling the ink jet recording apparatus comprising the carriage for mounting the recording head for effecting the recording by discharging the recording ink and for moving the recording head, and the recovery means for effecting the recovery operation with respect to the recording head, since the method comprises the steps of forwarding the ink jet recording apparatus from a manufacturing factory in a condition that the recording head filled with the transporting ink different from the recording ink is mounted on the carriage, and executing the on-arrival recovery mode different from the normal recovery mode executed by the recovery means after first usage of the recording apparatus by the user by means of the recovery means upon the first usage, with respect to the recording head, even when the composition of the transporting ink is specialized in order to maintain the recording quality of the recording head 3 during the transportation from the manufacturing factory from which the ink jet recording apparatus is forwarded to the user or during storage of the recording apparatuses previously filled in the recording head, the exchange from the transporting ink to the recording ink at the first usage of the recording apparatus by the user can be effected positively, removal of the residual transporting ink within the recovery means can be promoted, and re-transferring of the residual transporting ink onto the recording head 3 can be prevented, with the result that the time for setting the recording head 3 at the start of usage of the recording apparatus can be minimized, inconvenience due to erroneous setting of the recording head 3 can be avoided, setting-up ability of the recording apparatus can be enhanced, and poor recording quality due to the transporting ink at the initial stage of usage of the recording apparatus can be eliminated.

Further, according to the aforementioned embodiments, in the method for handling the ink jet recording apparatus comprising the carriage for mounting the recording head for effecting the recording by discharging the recording ink and for moving the recording head, and the recovery means for effecting the recovery operation with respect to the recording head, since the method comprises the steps of forwarding the ink jet recording apparatus from the manufacturing factory in a condition that the recording head filled with the transporting ink different from the recording ink is mounted on the carriage, and executing an on-arrival recovery mode same as the recovery mode executed upon exchange of the recording head among a plurality of recovery modes executed by the recovery means after first usage of the recording apparatus by the user by means of the recovery means upon the first usage, with respect to the recording head, even if the recording head 3 is exchanged for any reason when the user initially uses the recording apparatus, the exchange from the transporting ink to the recording ink can be effected positively at the first usage of the recording apparatus without increasing the recovery modes, and removal of the residual transporting ink in the recovery system 10 can be promoted, and re-transferring of the residual transporting ink onto the recording head 3 can be prevented, thereby simplifying the operation sequence of the recording apparatus.

Furthermore, according to the aforementioned embodiments, in the method for handling the ink jet recording apparatus comprising the carriage for mounting the recording head for effecting the recording by discharging the recording ink and for moving the recording head, and the mounting section for mounting the ink tank for storing the recording ink to be supplied to the recording head, since the method comprises the steps of forwarding the ink jet recording apparatus from the manufacturing factory in a condition that the recording head filled with transporting ink different from the recording ink is mounted on the carriage, and emitting an alarm to the user of the recording apparatus if the fact that the ink tank is not mounted on the mounting section upon first usage of the recording apparatus by the user is detected, the recording ink tank 9 can positively be set in the on-arrival recovery mode, the exchange operation from the transporting ink to the recording ink in the recording head 3 can be effected more positively, and good image quality can be maintained continuously from the initiation of usage of the recording apparatus.

Incidentally, in the aforementioned embodiments, while an example that the ink jet recording apparatus of serial recording type in which the recording is effected while moving the recording heads 3 relative to the recording medium P is used was explained, the present invention can similarly be applied to an ink jet recording apparatus of the line recording type in which the recording is effected only by sub-scanning by using a line type recording head having a length for covering a width of the recording medium entirely or partially, thereby achieving similar effects. Further, the present invention can similarly be applied to recording apparatuses using a single recording head, color recording apparatuses using a plurality of recording heads for effecting recording with different color inks, gradation recording apparatuses using a plurality of recording heads for effecting recording with same color and with different densities and combinations thereof, thereby achieving similar effects.

Incidentally, although the present invention can be applied to ink jet recording apparatuses having recording heads using electrothermal converters or piezo-electric elements, among others, when the present invention is applied to an ink jet recording apparatus using recording heads of a type in which ink is discharged by utilizing thermal energy, excellent effects are achieved. According to such a type, high density recording and highly fine recording can be achieved.

What is claimed is:

1. An ink jet recording apparatus to be shipped in which a recording head filled with transporting ink different from recording ink is mounted on a carriage, said apparatus comprising:

recovery means for effecting a recovery operation with respect to said recording head; and control means for controlling said recovery means such that an on-arrival recovery mode executed first by said recovery means after arrival of said recording apparatus differs from a normal recovery mode executed by said recovery means after a first usage of said recording apparatus, wherein viscosity of the transporting ink is greater than that of the recording ink.

2. An ink jet recording apparatus according to claim 1, wherein said recovery means comprises suction means for effecting suction from said recording head, and suction pressure in ink suction from said recording head by said suction means in the on-arrival recovery mode is set to be greater than suction pressure in ink suction in the normal recovery mode.

3. An ink jet recording apparatus according to claim 1, wherein said recovery means comprises suction means for effecting suction from said recording head, and a suction amount in ink suction from said recording head by said suction means in the on-arrival recovery mode is set to be greater than a suction amount in ink suction in the normal recovery mode.

4. An ink jet recording apparatus according to claim 1, wherein said recovery means comprises suction means for effecting suction from said recording head, and a number of suction operations in ink suction from said recording head by said suction means in the on-arrival recovery mode is set to be greater than a number of suction operations in ink suction in the normal recovery mode.

5. An ink jet recording apparatus according to claim 1, wherein the on-arrival recovery mode is a mode in which one kind of recovery operation in the normal recovery mode is continuously executed a plurality of times.

6. An ink jet recording apparatus according to claim 1, wherein said recovery means includes suction means for effecting suction from said recording head, and a number of idle suction operations for discharging the ink from a cap by driving said suction means in a communication condition between an interior of said cap and the atmosphere upon ink suction from said recording head by said suction means in the on-arrival recovery mode is set to be greater than a number of idle suction operations in the normal recovery mode.

7. An ink jet recording apparatus according to claim 1, wherein said recovery means includes suction means for effecting suction from said recording head and a wiper for wiping said recording head, and, in the on-arrival recovery mode, after ink suction from said recording head is firstly effected by said suction means, wiping of said wiper is effected.

8. An ink jet recording apparatus according to claim 1, wherein the recording ink includes color material and the transporting ink does not include color material or has less of a color component than that of the recording ink.

9. An ink jet recording apparatus according to claim 1, wherein said recording head includes an ink discharging electrothermal converter for generating thermal energy utilized for discharging the ink.

10. An ink jet recording apparatus according to claim 9, wherein the ink is discharged by utilizing pressure change based on growth of a bubble created by film boiling caused by the thermal energy generated by said electrothermal converter.

11. An ink jet recording apparatus according to claim 1, wherein said recovery means comprises suction means for effecting ink suction from said recording head and the transporting ink is heated by an ink temperature maintaining electrothermal converter within said recording head before or during the ink suction by said suction means in the on-arrival recovery mode.

12. An ink jet recording apparatus according to claim 1, wherein said recovery means comprises suction means for effecting ink suction from said recording head and the transporting ink is heated by an ink discharging electrothermal converter within said recording head before or during the ink suction by said suction means in the on-arrival recovery mode.

13. An ink jet recording apparatus according to claim 1, wherein said recovery means comprises suction means for effecting ink suction from said recording head and the transporting ink is heated by an ink temperature maintaining electrothermal converter and an ink discharging electrothermal converter within said recording head before or during the ink suction by said suction means in the on-arrival recovery mode.

14. An ink jet recording apparatus according to claim 1, wherein said recovery means comprises suction means for effecting ink suction from said recording head and the transporting ink is discharged by an ink discharging electrothermal converter within said recording head before or during the ink suction by said suction means in the on-arrival recovery mode.

15. An ink jet recording apparatus according to claim 1, wherein said recovery means comprises suction means for effecting ink suction from said recording head and the transporting ink is heated by an ink temperature maintaining electrothermal converter within said recording head and the transporting ink is discharged by an ink discharging electrothermal converter during the ink suction by said suction means in the on-arrival recovery mode.

16. An ink jet recording apparatus according to claim 1, wherein said recovery means comprises suction means for effecting ink suction from said recording head and the transporting ink is heated by an ink temperature maintaining electrothermal converter within said recording head from before the ink suction to the end of the ink suction by said suction means in the on-arrival recovery mode.

17. An ink jet recording apparatus according to claim 1, wherein said recovery means comprises suction means for effecting ink suction from said recording head and the transporting ink is heated by an ink discharging electrothermal converter within said recording head from before the ink suction to the end of the ink suction by said suction means in the on-arrival recovery mode.

18. An ink jet recording apparatus according to claim 1, wherein said recovery means comprises suction means for effecting ink suction from said recording head and the transporting ink is heated by an ink temperature maintaining electrothermal converter and an ink discharging electrothermal converter within said recording head from before the ink suction to the end of the ink suction by said suction means in the on-arrival recovery mode.

19. An ink jet recording apparatus according to claim 1, wherein said recovery means comprises suction means for effecting ink suction from said recording head and the transporting ink is discharged by an ink discharging electrothermal converter within said recording head from before the ink suction to the end of the ink suction by said suction means in the on-arrival recovery mode.

20. An ink jet recording apparatus according to claim 1, wherein said recovery means comprises suction means for effecting ink suction from said recording head and the transporting ink is heated by an ink temperature maintaining electrothermal converter and the transporting ink is discharged by an ink discharging electrothermal converter within said recording head from before the ink suction to the end of the ink suction by said suction means in the on-arrival recovery mode.

21. An ink jet recording apparatus according to claim 1, wherein said recovery means comprises suction means for effecting ink suction from said recording head and, when the transporting ink is heated and discharged by an ink discharging electrothermal converter within said recording head from before the ink suction to the end of the ink suction by said suction means in the on-arrival recovery mode, an input signal value, frequency, ink color to be inputted and a discharge port can be selected appropriately, and any input signal value, frequency and ink color can be inputted to said electrothermal converter of said recording head.

22. An ink jet recording apparatus according to claim 1, further comprising time counting means for counting an elapsed time from when the recording apparatus is shipped.

23. An ink jet recording apparatus according to claim 1, further comprising time reading means for reading an elapsed time from when the recording apparatus is shipped.

24. An ink jet recording apparatus according to claim 1, further comprising control means for judging and determining a heating amount of said recording head on the basis of an elapsed time from when the recording apparatus is shipped.

25. An ink jet recording apparatus according to claim 1, further comprising temperature history storing means for storing a temperature history from when the recording apparatus is shipped.

26. An ink jet recording apparatus according to claim 1, further comprising temperature history reading means for reading a temperature history from when the recording apparatus is shipped.

27. An ink jet recording apparatus according to claim 1, further comprising heating control means for judging and determining a heating amount of said recording head on the basis of a temperature history from when the recording apparatus is shipped.

28. An ink jet recording apparatus according to claim 27, wherein a heating temperature for each color can be set by said heating control means.

29. An ink jet recording apparatus according to claim 1, further comprising storing means capable of re-writing and calling an elapsed time and temperature history from when the recording apparatus is shipped.

30. An ink jet recording apparatus to be shipped in which a recording head filled with transporting ink different from recording ink is mounted on a carriage, said apparatus comprising:

recovery means for effecting a recovery operation with respect to said recording head; and control means for controlling said recovery means such that an on-arrival recovery mode executed first by said recovery means after arrival of said recording apparatus differs from a normal recovery mode executed by said recovery means after a first usage of said recording apparatus, wherein said recovery means includes suction means for effecting suction from said recording head and a wiper for wiping said recording head, and a number of wiping operations of said wiper after ink suction from said recording head by said suction means in the on-arrival recovery mode is set to be greater than a number of wiping operations after ink suction in the normal recovery mode.

31. An ink jet recording apparatus to be shipped in which a recording head filled with transporting ink different from recording ink is mounted on a carriage, said apparatus comprising:

recovery means for effecting a recovery operation with respect to said recording head; and control means for controlling said recovery means such that an on-arrival recovery mode executed first by said recovery means after arrival of said recording apparatus differs from a normal recovery mode executed by said recovery means after a first usage of said recording apparatus, wherein said recovery means includes a wiper for wiping said recording head and a cleaner for cleaning said wiper, and a number of cleaning operations of said cleaner after the wiping of said wiper in the on-arrival recovery mode is set to be greater than a number of cleaning operations after the wiping in the normal recovery mode.

32. An ink jet recording apparatus to be shipped in which a recording head filled with transporting ink different from recording ink is mounted on a carriage, said apparatus comprising:

recovery means for effecting a recovery operation with respect to said recording head; and control means for controlling said recovery means such that an on-arrival recovery mode executed first by said recovery means after arrival of said recording apparatus is the same as a recovery mode executed by said recovery means when said recording head is exchanged, wherein viscosity of the transporting ink is greater than that of the recording ink.

33. An ink jet recording apparatus to be shipped in which a recording head filled with transporting ink different from the recording ink is mounted on a carriage, said apparatus comprising:

recovery means for effecting a recovery operation with respect to said recording head;

detection means for detecting whether an ink tank for storing recording ink is mounted on said carriage; and alert means for providing an alert if said detection means detects that said ink tank is mounted on said carriage when the recovery operation is executed for a first time after arrival of said recording apparatus, wherein viscosity of the transporting ink is greater than that of the recording ink.

34. A method for handling an ink jet recording apparatus comprising a carriage for mounting a recording head for effecting recording by discharging recording ink and for moving the recording head, and recovery means for effecting a recovery operation with respect to the recording head, the method comprising the steps of:

shipping the ink jet recording apparatus from a manufacturing factory in a condition that the recording head filled with transporting ink different from the recording ink is mounted on the carriage; and controlling the recovery means such that an on-arrival recovery mode executed first by the recovery means after arrival of the recording apparatus differs from a normal recovery mode executed by the recovery means after a first usage of the recording apparatus, wherein viscosity of the transporting ink is greater than that of the recording ink.

35. A method for handling an ink jet recording apparatus comprising a carriage for mounting a recording head for effecting recording by discharging recording ink and for moving the recording head, and recovery means for effecting a recovery operation with respect to the recording head, the method comprising the steps of:

shipping the ink jet recording apparatus from a manufacturing factory in a condition that the recording head filled with transporting ink different from the recording ink is mounted on the carriage; and controlling the recovery means such that an on-arrival recovery mode executed first by the recovery means after arrival of the recording apparatus is the same as a recovery mode executed by the recovery means when the recording head is exchanged, wherein viscosity of the transporting ink is greater than that of the recording ink.

* * * * *

UNITED STATES PATENT AND TRADEMARK OFFICE

CERTIFICATE OF CORRECTION

PATENT NO. : 6,783,205 B2
DATED : August 31, 2004
INVENTOR(S) : Saijo et al.

It is certified that error appears in the above-identified patent and that said Letters Patent is hereby corrected as shown below:

Title page,
After Item [57], ABSTRACT,
"35 claims" should read -- 36 claims --.

Column 2,
Line 12, "by" should read -- for --.

Column 11,
Line 29, "head.3" should read -- head 3 --.

Column 13,
Line 1, "in" should be deleted.

Column 14,
Line 28, "independence" should read -- in dependence --.

Column 16,
Line 6, "is" should read -- are --.
Line 8, "land" should read -- 1 and --.

Column 18,
Line 16, "ash" should read -- as --.

Column 27,
Line 35, "wipers." should read -- wipers --.

Column 29
Line 9, "the," (first occurrence) should read -- the --.

UNITED STATES PATENT AND TRADEMARK OFFICE

CERTIFICATE OF CORRECTION

PATENT NO. : 6,783,205 B2
DATED : August 31, 2004
INVENTOR(S) : Saijo et al.

It is certified that error appears in the above-identified patent and that said Letters Patent is hereby corrected as shown below:

Column 36,
After line 47, insert -- 36. A method for handling an ink jet recording apparatus comprising a carriage for mounting a recording head for effecting recording by discharging recording ink and for moving the recording head, and a mounting section for mounting an ink tank for storing the recording ink to be supplied to the recording head, the method comprising the steps of:

shipping the ink jet recording apparatus from a manufacturing factory in a condition that the recording head filled with transporting ink different from the recording ink is mounted on the carriage;

effecting a recovery operation of the recording head by use of recovery means;

detecting whether the ink tank is mounted on the carriage; and providing an alert if detected that the ink tank is mounted on the carriage when the recovery operation is executed for a first time after arrival of the recording apparatus, wherein viscosity of the transporting ink is greater than that of the recording ink. --.

Signed and Sealed this

Twenty-fourth Day of May, 2005

JON W. DUDAS
*Director of the United States Patent and Trademark Office*